US005851166A

United States Patent [19]

Bernardson

[11] Patent Number: 5,851,166

[45] Date of Patent: Dec. 22, 1998

[54] LOWER EXTREMITY REHABILITATION AND TONING EXERCISE APPARATUS AND METHOD

[76] Inventor: Peter S. Bernardson, 339 Berger St., Emmaus, Pa. 18049-2307

[21] Appl. No.: 509,206

[22] Filed: Jul. 31, 1995

[51] Int. Cl.[6] ..... A63B 23/04

[52] U.S. Cl. ..... 482/79

[58] Field of Search ..... 482/51, 79, 80, 482/121

[56] References Cited

U.S. PATENT DOCUMENTS

| | | | |
|---|---|---|---|
| 1,509,793 | 9/1924 | Thompson . | |
| 1,587,749 | 6/1926 | Bierly | 482/80 |
| 2,041,693 | 5/1936 | Boltz et al. . | |
| 3,295,847 | 1/1967 | Matt, Sr. . | |
| 3,421,760 | 1/1969 | Freeman, Jr. . | |
| 3,525,522 | 8/1970 | Piller . | |
| 3,598,404 | 8/1971 | Bowman . | |
| 3,741,540 | 6/1973 | Shimizu | 272/83 R |
| 3,984,100 | 10/1976 | Firster . | |
| 4,159,111 | 6/1979 | Lowth . | |
| 4,199,137 | 4/1980 | Giguere . | |
| 4,204,675 | 5/1980 | McGinnis . | |
| 4,270,749 | 6/1981 | Hebern . | |
| 4,279,415 | 7/1981 | Katz . | |
| 4,306,714 | 12/1981 | Loomis et al. . | |
| 4,466,611 | 8/1984 | Paster . | |
| 4,501,421 | 2/1985 | Kane et al. . | |
| 4,629,181 | 12/1986 | Krive | 482/79 |
| 4,635,932 | 1/1987 | Dewees | 482/79 |
| 4,694,684 | 9/1987 | Campbell, III . | |
| 4,739,986 | 4/1988 | Kucharik et al. . | |
| 4,862,875 | 9/1989 | Heaton . | |
| 4,921,243 | 5/1990 | Weidmann . | |
| 4,998,720 | 3/1991 | Kim . | |
| 5,256,118 | 10/1993 | Chen . | |
| 5,267,923 | 12/1993 | Piaget et al. . | |
| 5,267,924 | 12/1993 | Miller et al. . | |
| 5,277,677 | 1/1994 | Terauds . | |
| 5,304,105 | 4/1994 | Hsieh . | |
| 5,368,536 | 11/1994 | Stodgell . | |
| 5,433,684 | 7/1995 | Carrillo . | |

*Primary Examiner*—Stephen R. Crow
*Attorney, Agent, or Firm*—Eckert Seamans Cherin & Mellott, LLC

[57] ABSTRACT

A rocking-type foot and lower leg exercising apparatus incorporates one or two centrally pivoted pedals mounted upon a base in a position facilitating the placement of the feet of the user upon such pedals while seated in a chair and rocking of the pedals with the foot positioned upon them to provide a soothing motion that will maintain the tone of the muscles of the legs and encourages blood circulation in the feet and legs. The pivot point of the pedals may be located at any vertical position between the base and the pedal, but is located longitudinally between about one fourth to one half of the distance from the end of the heel position on the pedals.

24 Claims, 9 Drawing Sheets

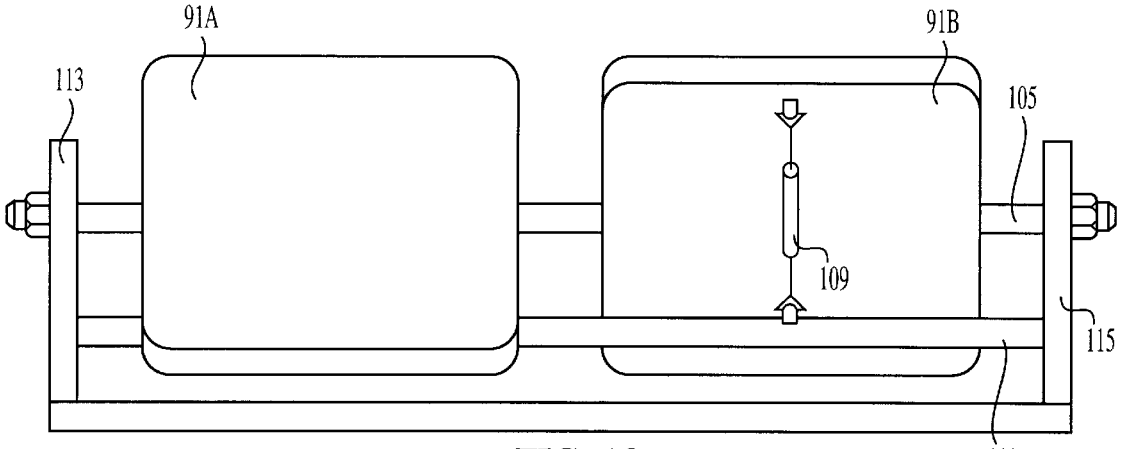
FIG. 18
FIG. 19
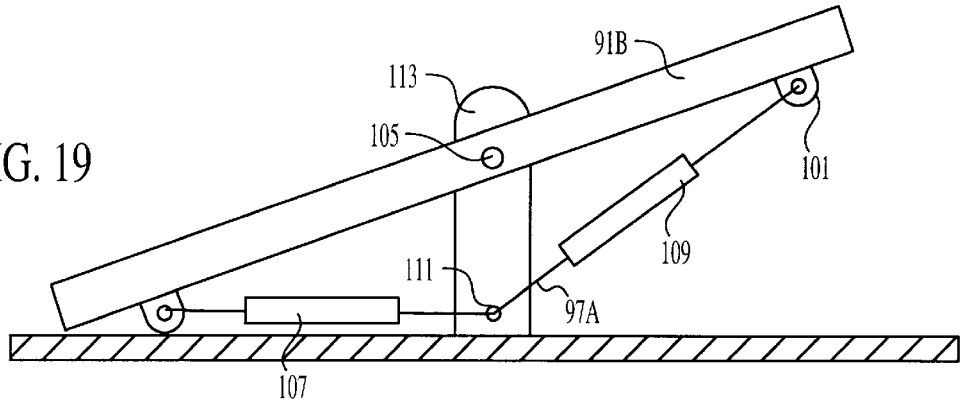
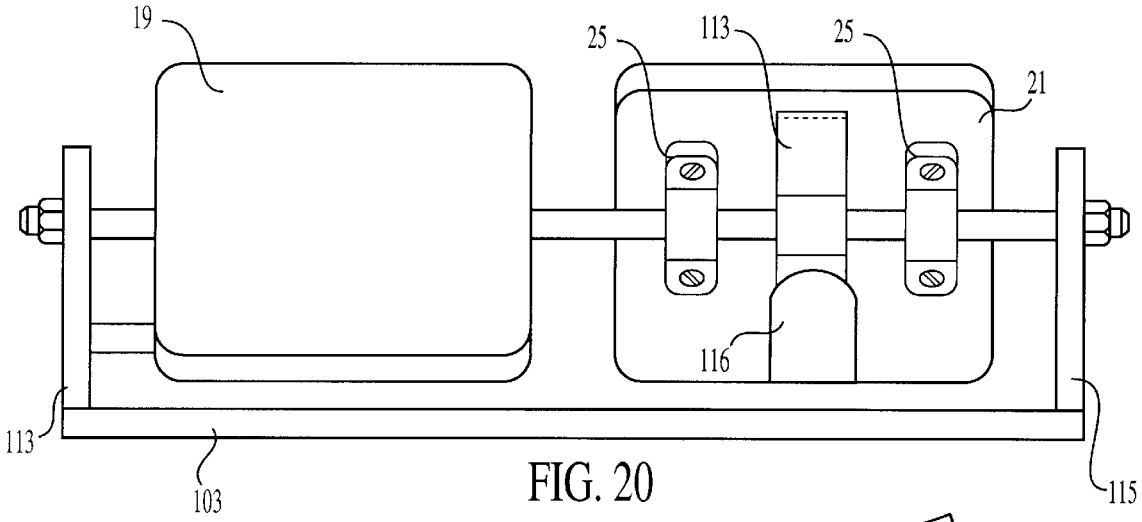
FIG. 20
FIG. 21
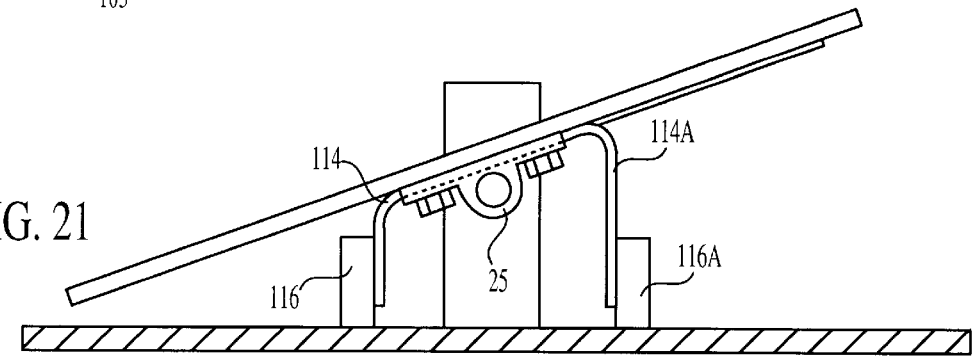

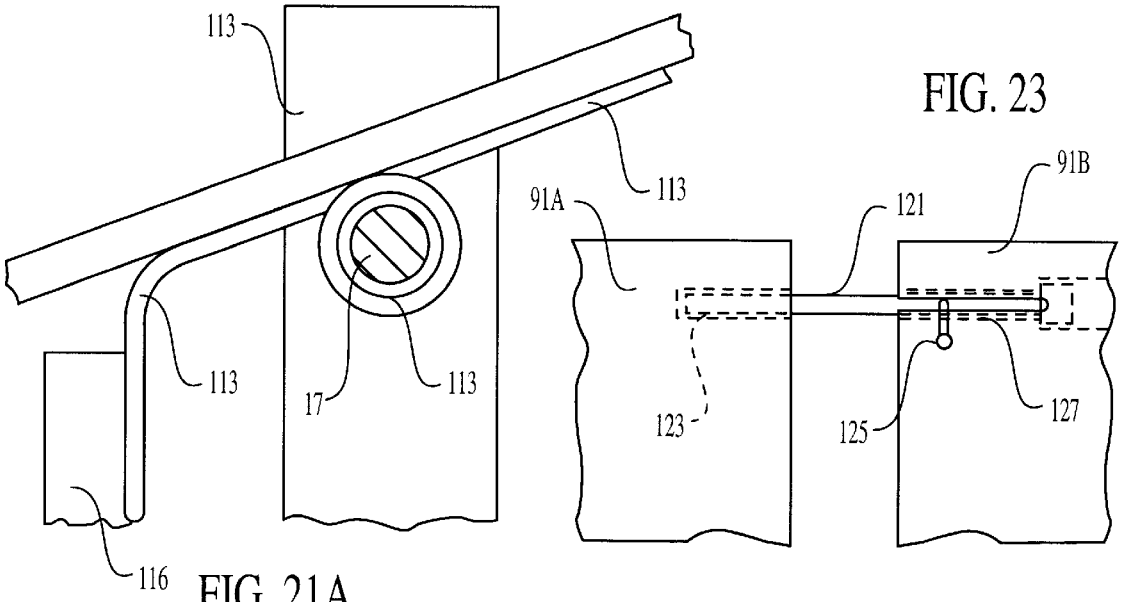
FIG. 23
FIG. 21A
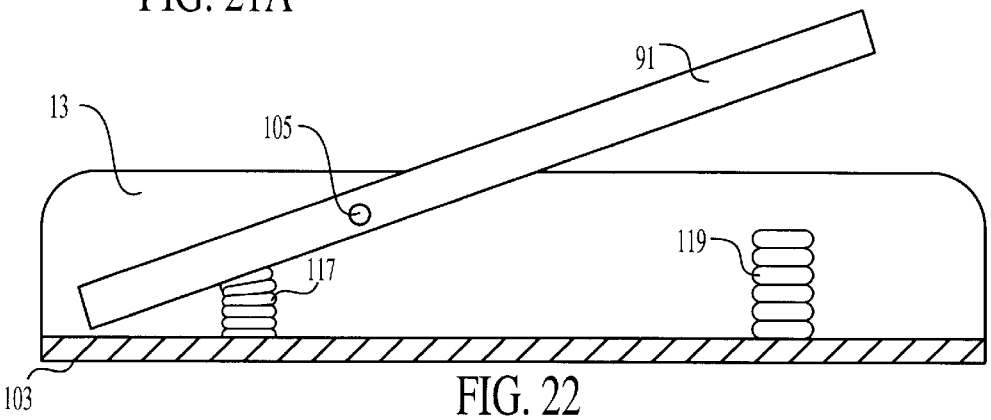
FIG. 22
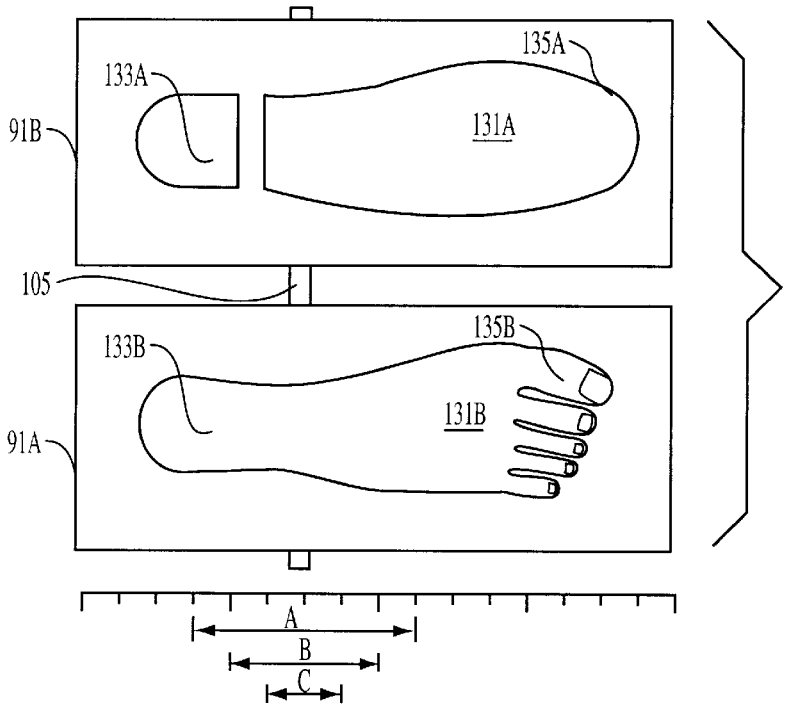
FIG. 24

LOWER EXTREMITY REHABILITATION AND TONING EXERCISE APPARATUS AND METHOD

BACKGROUND OF THE INVENTION (1) Field of the Invention

This invention relates to medical rehabilitation and general exercise and toning of the lower extremities and particularly to an apparatus and method for maintaining circulation in the feet and lower legs of individuals while they are seated or confined to a chair or the like.

(2) Prior Art

Vigorous athletes such as runners and the like frequently injure their lower legs and/or feet necessitating relatively severe restriction of movement during healing. For example, runners are relatively frequently subject to so-called "shin splints", or hairline stress fractures of the bones of the lower leg as well as cramps of the calf muscles which can pull or tear the muscle tissue resulting in long term enforced inactivity to allow healing. During such enforced inactivity, much of which may be passed resting or reclining in a chair or the like, vigorous athletes such as runners and the like frequently become quite uncomfortable and even nervous from lack of exercise, particularly of the lower extremities. Furthermore, enforced inactivity tends to delay healing of the injuries suffered. Frequently, such injured persons, like most modern humans, and particularly the residents of cities, will spend an inordinate amount of time reclining or sitting in a chair or the like before a television set or even seated in a chair while involved in other activities. Circulation in such cases is seriously decreased to the lower extremities of the individuals involved, tending to induce various physical ills. The same difficulties are thus encountered by nonathletes as for injured athletes.

Decreased circulation in the lower extremities is particularly detrimental in older persons who are not only subject to pooling of blood in the lower limbs due to inactivity, but also to resultant infections of the veins and arteries, blood clots in the lower extremities and other difficulties due, in particular, to inactivity, aggravated in many cases by weakening of the heart. Such, weakening itself is due frequently also to inactivity as well, which allows the muscular tissue of the heart to lose tone and become weaker at the same time as extra strain is placed on the heart. Such extra strain is due largely to lack of movement of the muscles, particularly of the calves of the legs, which are the largest muscles of the body positioned essentially a maximum distance from the heart. Movement of the muscles of the lower extremities in particular, where many of the major muscles and blood vessels of the body are located, serves normally to significantly aid in pumping blood through the body due to a combination of kneading, or continuing variable pressure, of the moving muscles against adjacent blood vessels, combined with the action of valves in the vessels which allows movement of blood in only one direction. Because of the structure of the valves in the blood vessels and particularly the veins, pressure on the side of the vessel which deforms the vessel and displaces blood within it can expel the blood only in one direction so long as such vessel remains undiseased or uninjured. In other words, blood is moved through the venous system in particular by force upon the blood vessels coupled with one-way valves in the vessels, very much as blood is, in fact, moved through the heart by pressure of the moving or pulsing walls of the heart muscle combined with the various valves in the heart resulting in forcing blood progressively through the heart from one chamber to another and then out into the body. Aid in moving the venous blood through the venous vessels is particularly important, since the pressure of the heart beat is not really directly exerted upon the blood in such vessels due to the small size of the vessels in the capillary system intervening between the arterial and venous blood systems in the circulation of blood. The greatly reduced diameter of such capillaries essentially damps out pulses from the heart leaving only a small steady pressure to move the blood back through the venous vessels, other than for any impetus from compression of the venous vessels along the way by the skeletal muscles. It is frequently estimated that in active walking or running, a significant percentage of the actual pumping of blood in the body, up to as much as twenty to twenty-five percent or more, is due to the pumping effects of blood moving through the vessels of the legs under the impetus of muscles squeezing against the blood vessels. It is for this reason that runners, for example, at the end of a race or the like, are advised not to stop all at once, because with the cessation of movement, the full burden of moving or pumping the blood is thrown completely on the heart and, if the heart should be already near its limit of work or strength available, as can occur particularly near the end of a competitive athletic event, with the sudden subtraction or cessation of the aid of the muscles acting against the blood vessels, it is possible for the heart to fail or even for only the blood supply to fail to the brain resulting in possible fainting or collapse and possible resultant trauma from falling or even complete collapse with the potential for possibly permanent injury. As will be realized, therefore, a certain amount of movement of the lower extremities can be very important in maintaining health even in fairly vigorous persons. It becomes then ever more important in those persons tending either by inclination or necessity to a sedentary life. Consequently, there is a need for a practical exercise apparatus to enable movement in the lower extremities to be continued at least on a reduced scale by those persons subjected to long periods of inactivity, particularly in a seated position.

There are other persons who are forced by circumstances, even if their inactivity is not medically mandated, to endure long periods of enforced inactivity such as computer and word processor operators, other office workers and the like. Such persons usually have the option to get up and walk or move around periodically, but still tend to suffer from stagnation of circulation in their lower extremities as well as stiffness and tension. In recent years, there have been serious attempts to provide ergonomically designed office machines and office furniture such as chairs and the like, but these efforts have been directed more toward developing less tiring office machines to operate rather than providing ways to actually relax the body and maintain circulation by mild exercise.

There have been, it is true, a number of small scale exercise machines for exercising the legs as well as the usual large scale machines such as treadmills, bicycling machines and so-called stepping machines. Most, if not all of these latter, however, have been designed for stepping on or placing the weight alternately upon first one leg and then the other while in a standing position, or, at a minimum, while being in a cycling position such as in the use of a stationary bicycle or the like. None, so far as the present inventor is aware, has been devised for use by persons more conventionally seated in a conventional chair such as, for example, desk chairs or so-called easy chairs. Some of the more pertinent prior art small scale patented exercise machines are set forth in the following fairly recent patents.

U.S. Pat. No. 5,256,118 issued Oct. 26, 1993 to T. Chen discloses a small scale so called "stepper" device or pedal exerciser in which two adjacent pedals are pivoted at one end and act against a pair of air bellows between the pedals and a base. The bellows allow the pedals to rise and fall resiliently as the user transfers his or her weight alternatively from one to the other pedal. The device is not suitable for operating from the usual sitting position.

U.S. Pat. No. 5,267,923 issued Dec. 7, 1993 to G. Piaget et al. also discloses a stepper-type exercise machine involving the use of bellows at the opposite end of pedals from a pivot point for such pedals incorporated in a small scale, easily portable and storable exercise machine. While the arrangement of the pedals of the Piaget machine is such that it could possibly be used from a seated position, such use would be quite awkward unless the seating was in a position such as is usually assumed on a bicycle or the like.

U.S. Pat. No. 5,290,204 issued Mar. 1, 1994 to M. Lee discloses a small compact pedaling machine in which the pedals are pivoted at one end and movement is resisted by a fluid cylinder means of a suitable type and including a coordinating arm to allow only one pedal to be depressed at a time.

U.S. Pat. No. 5,304,105 issued Apr. 19, 1994 to K. C. Hsieh discloses a small scale stepping-type exerciser in which the pedals are again pivoted at one end and are rendered resiliently movable by the use of interconnected inflatable balls positioned under the pedals. As with the previous Piaget et al. patent, the Hsieh device could be used with some difficulty from a seated position, but is not conveniently designed for such use.

U.S. Pat. No. 5,299,995 issued Apr. 5, 1994 to C. Ko discloses a relatively small scale foot or leg exercising device in which a pair of conventionally pivoted bicycle pedals are mounted on flexible members having a reciprocable movement in an adjustably pivoting tower arrangement which allows the user to, in effect, obtain a bicycling exercise motion from a seated position. The essential movement of the pedals is up and down on the apparatus.

There is a need, consequently, for a small, easily portable and readily usable apparatus for mildly exercising the lower extremities, and particularly the feet and calves, from a sitting position such as is customarily assumed when watching television, operating a computer, traveling in a car or plane or the like, which will keep the legs and feet moving, but will not injure, for example, already injured muscles or ligaments. There is also a need for a method for use of this and similar apparatus to exercise the lower extremities.

OBJECTS OF THE INVENTION

It is an object of the present invention, therefore, to provide an apparatus in which a foot support or pedal pivots from a central or near central area of the support so that the support is conveniently and easily operated with a rocking motion from a conventional seated position.

It is a further object of the invention to provide an exercise apparatus that provides a gentle rocking motion to the feet from a seated position causing movement in the muscles of the lower extremities without excessive movement tending to distract the exerciser or overextend injured tissues.

It is a still further object of the invention to provide a mild exercise and movement of the feet of the user that will be effective to relieve tension in the lower portion of the lower extremities and keep the blood circulating in the tissues involved.

It is a still further object of the invention to provide a rocking motion foot excerciser that can be used from a seated position to move and mildly exercise the feet either with or without resilient resistance to such rocking motion.

It is a still further object of the invention to provide a rocking-type foot exerciser that can be used from a seated position in which the rocking motion can be inactivated and the apparatus used as a simple foot rest.

It is a still further object of the invention to provide a rocking-type foot exerciser having two centrally pivoted pedals which can operate independently or coordinated so that the pedals act as a single pedal coordinated to rock in alternating fashion or alternatively together in unison.

BRIEF DESCRIPTION OF THE INVENTION

A lower extremity exercising device has a base upon which are preferably mounted two pedals each pivoted in a central portion of the pedal such that the pedals may be rocked by a back-and-forth rocking of a user's foot upon the pedals while the user remains seated. The pedals may be preferably operated independently to provide maximum variability of motion to maximize relaxation, but can also be locked together for coordinated movement and can also be provided with resilient means or mechanism, preferably between the base and the pedal, to increase the resistance to movement and increase the exercise provided. The rocking pedals may be provided with several types of resilient means to provide additional resistance to movement of the pedal, the resistance being preferably, however, a resilient resistance such as provided, for example, by a coil spring-type resistance or the like.

BRIEF DESCRIPTION OF THE DRAWINGS

FIG. 9 is an isometric view of a portable version of the device of the invention in which a cover is provided that may be folded or pivoted upwardly to enclose the apparatus for carrying on an airplane or train or the like.

FIG. 18 is an end view of a still further alternative embodiment of the invention.

FIG. 19 is a longitudinally sectioned side elevation of the embodiment shown in FIG. 18.

FIG. 20 is an end view of a still further embodiment of the invention with an alternative arrangement for providing resilience to the pedals.

FIG. 21 is a longitudinally sectioned side elevation of the embodiment of FIG. 20.

FIG. 21A is an enlarged detail of the mechanical arrangement of the spring assembly of the embodiment of the invention shown in FIGS. 20 and 21.

FIG. 22 is a longitudinally sectioned side elevation of an alternative arrangement for providing resilience to the pedals of the exercising apparatus of the invention.

FIG. 23 is an enlarged detail of an alternative arrangement for locking together and coordinating the movement of two pedals of an exercising machine in accordance with the invention.

FIG. 24 is a plan view of two typical pedals in accordance with the invention showing the arrangement of the feet of a user upon the pedal and the preferred placement of the pivot point with respect to the feet and the pedal.

DESCRIPTION OF THE PREFERRED EMBODIMENTS

Quite frequently, active persons or even relatively inactive persons, are injured so that they cannot safely continue effective exercises of their lower legs and in particular their feet and calves. However, cessation of exercise causes very rapid loss of tone and strength in the muscles and ligaments involved so that some form of continued exercise would be very beneficial both to maintain conditioning and promote healing by encouraging blood supply to the affected parts. In many, if not most, of these cases, it is not desired to provide really vigorous exercise, but only mild exercises to prevent a general stasis of the blood from ensuing as well as to soothe and make the patient more comfortable and place him or her in a better frame of mind. In addition, many persons having a relatively inactive work environment, including computer programmers, word processor operators and the like, often have difficulty in keeping adequate circulation in their lower limbs. Travelers in cars and airplanes also are exposed to long periods of sitting in relatively restricted positions that interfere with adequate circulation. It has been found by the present inventor that mild and soothing exercise can be attained in these cases by the use of a novel rocking exercise apparatus for the feet which allows the user to be comfortably seated in a chair or the like while they rock their feet upon rocking pedals on a portable exercise device encouraging circulation in the lower legs and feet and soothing the user. By periodically rocking the feet from front to back or vice versa from time to time or even continuously over a period of time, the user keeps the feet from becoming stiff and maintains a range of movement in the ankles. In addition, and very importantly, the user maintains a continuous or periodic kneading or massaging of the muscles, particularly of the relatively powerful calves, as well as the muscles toward the front of the lower legs upon adjacent blood vessels, maintaining circulation and combatting stasis or pooling of the blood in the tissues. Maintenance of circulation plus periodic movement not only increases physical fitness and health, but also has a desirable cosmetic effect of maintaining shapely calves, particularly in women. Periodic movement also contributes to comfort and general well being of the user.

Figure 1:
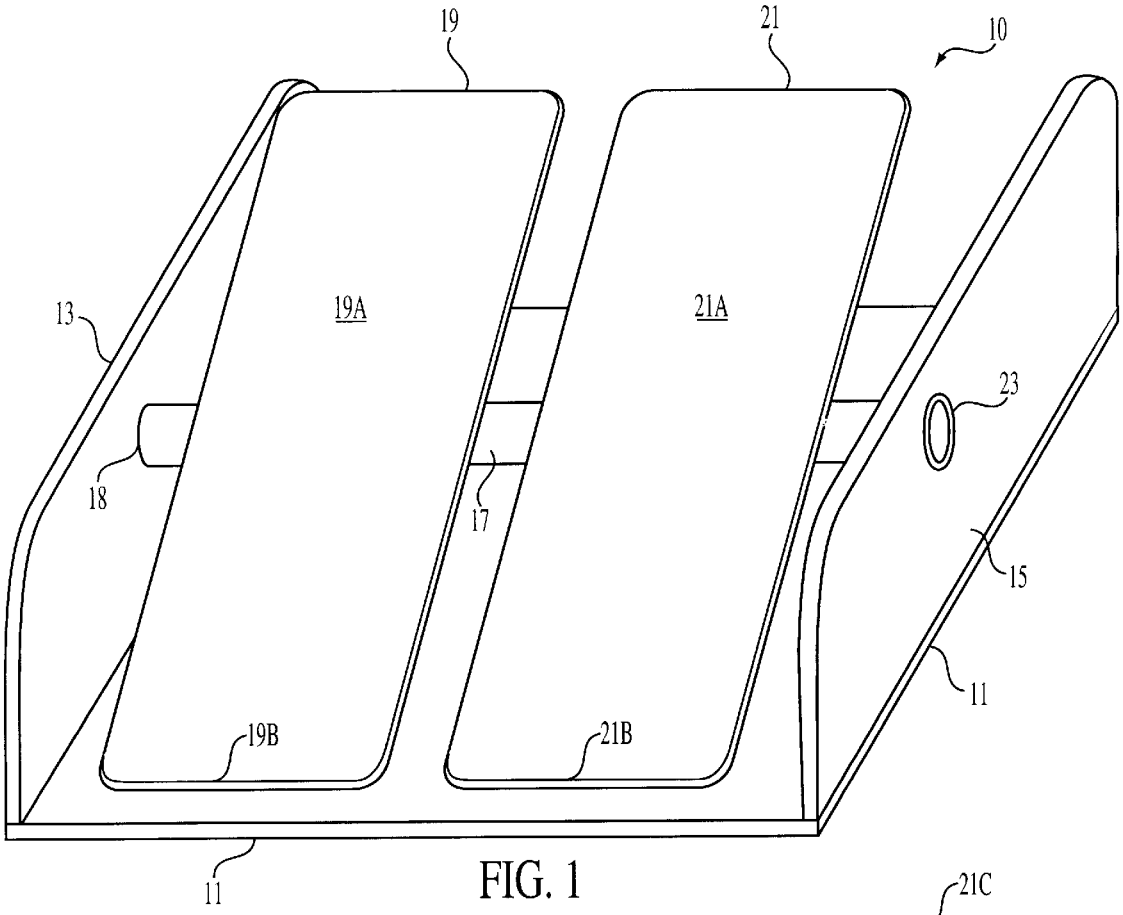
FIG. 1 is an isometric view of a basic embodiment of the invention.

FIG. 1 is an isometric view of a basic embodiment of the exercise device of the invention in which reference numeral 10 indicates the device broadly. It may be seen in FIG. 1 that the exercise device 10 is comprised of a base 11 adapted for placement on the floor of a room or other ground reference surface upon which one wishing to exercise or move their lower extremities or legs may place their feet in order to obtain both a guidance for rocking motion of the feet and in most instances, resistance against such rocking motion whereby their muscles and sinews, or ligaments, may be stressed to obtain the benefits of mild exercise. There is provided upon the base 11 a left side wall 13 and a right side wall 15 secured to the base 11 in any suitable manner, not shown. In proper instances, the side walls 13 and 15 may be integral continuations of the base 11. Attached to, or extending through the side walls 13 and 15 is a pivot rod 17, which, as shown, passes through orifices or openings 18 in the side walls 13 and 15. The opening 18 is obscured in side wall 15 by the fastening 23 on the end of the pivot rod 17, but can be seen in side wall 13 and it will be understood that a similar orifice 18 will be found in the side wall 15 and that a similar fastening 23 will be found on the opposite end of the pivot rod 17 adjacent to the outside of side wall 13. The pivot rod 17 supports pedals 19 and 21 upon which the feet of the user are placed during use.

Figure 2:
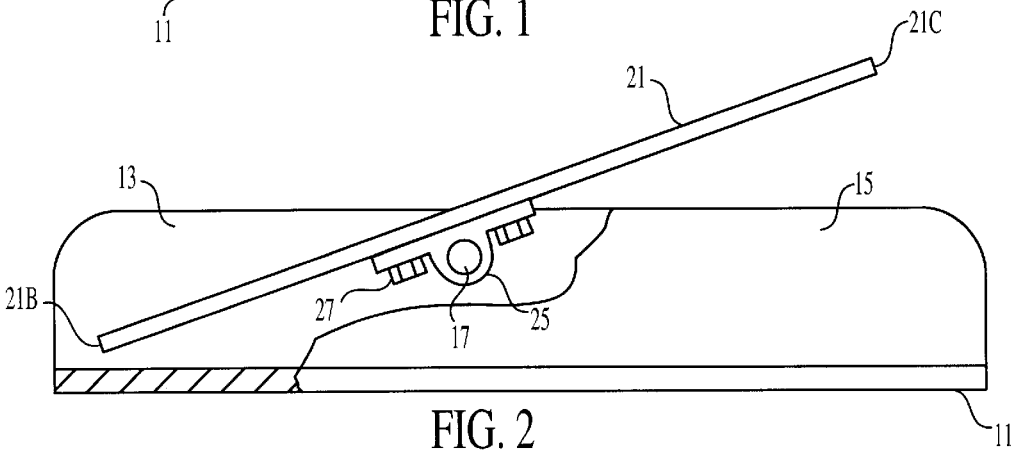
FIG. 2 is a side elevation, partly broken away, of the embodiment of the invention shown in FIG. 1.
Figure 2A:
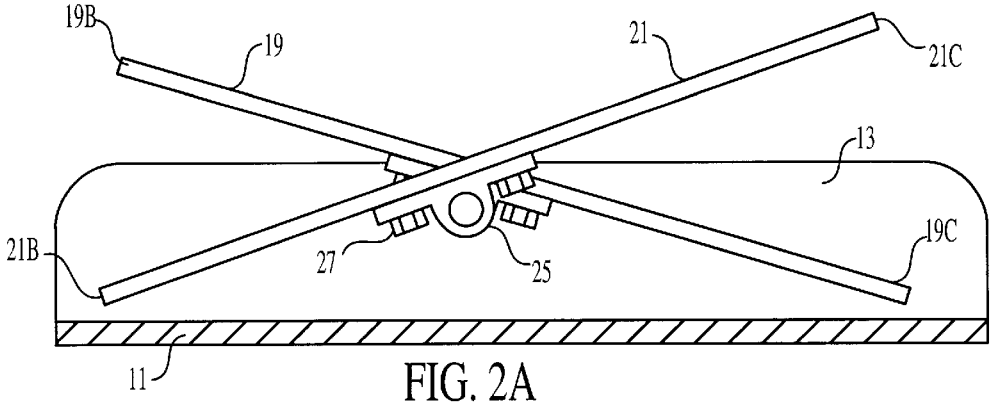
FIG. 2A is a partially broken away side elevation similar to FIG. 2 except that the two pedals are shown inclined oppositely.
Figure 2B:
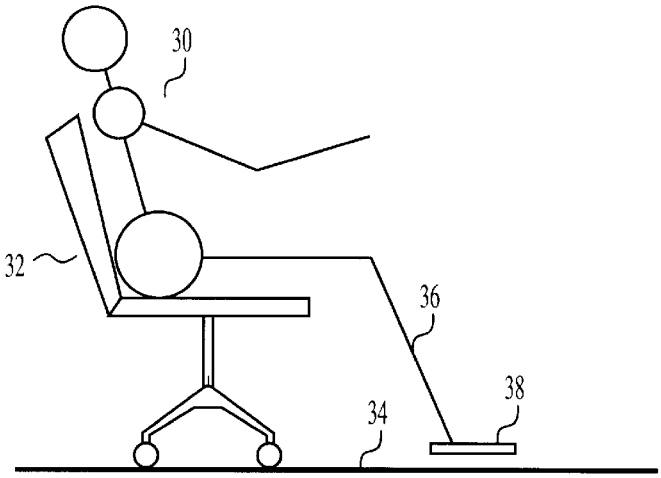
FIGS. 2B and 2C are diagrammatic figures illustrating the exercise movement attained with the invention.
Figure 2C:
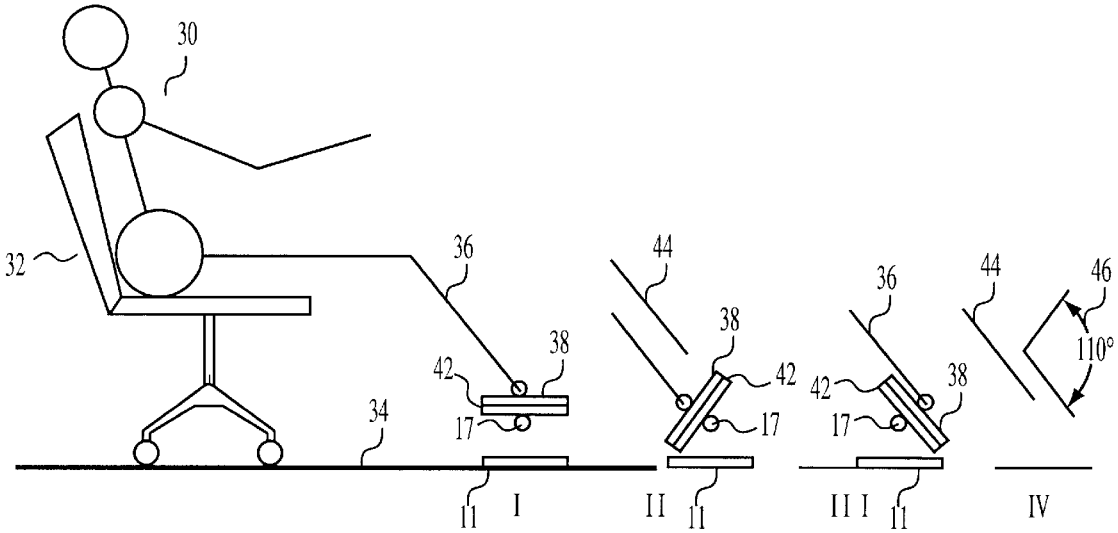
Figure 3:
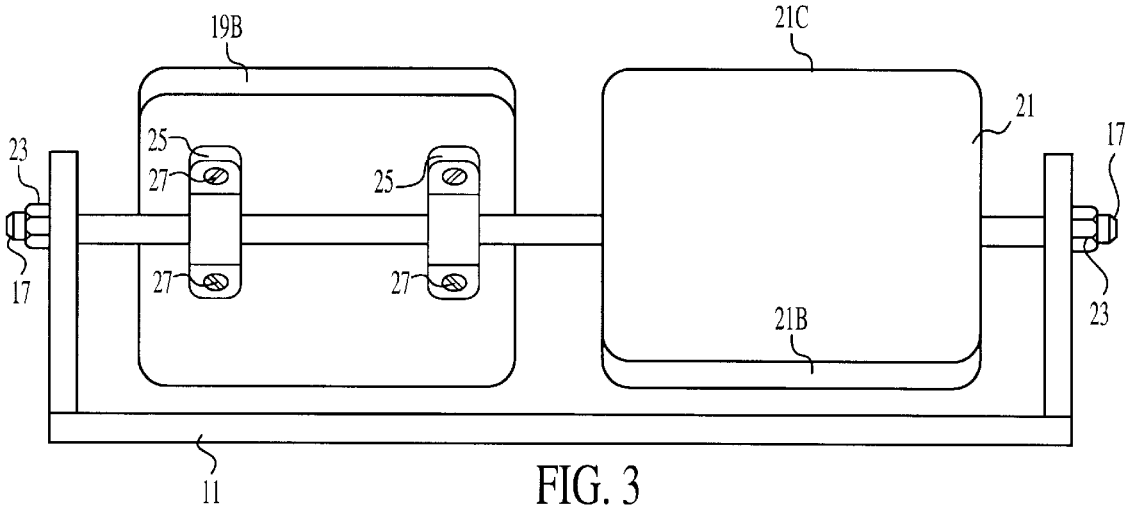
FIG. 3 is an end elevation of the embodiment of the intention shown in FIGS. 1 and 2 with the pedals inclined oppositely as shown in FIG. 2A.

Left pedal 19 and right pedal 21 are journaled upon the pivot rod 17 to which they are secured by pivot rod fittings 25 shown more particularly in FIGS. 2 through 3. The pivot rod fittings 25 which are secured to the pedals 19 and 21 via fastenings 27 should be understood to be loosely journaled on the pivot rod 17 so that the two pedals 19 and 21 may be independently rocked upon the pivot rod 17. The two pedals 19 and 21 constitute convenient foot contact and support means upon which the left and right feet of the user may be placed so that either the sole of the user's feet or the sole of any footwear which the user happens to be wearing are substantially completely supported against the support surface of the contact and support means or members. It will be understood in this regard that the heel of the user's foot will be placed upon the near end of the pedals 19 and 21 and the toe of the user's foot will be placed upon the far end of the upper surface of the pedals 19 and 21 so that the user's foot is basically in a comfortable position against the surface. Depending upon the height of the pivot rod 17 from the base 11 and the length of the pedals 19 and 21, the normal resting position of the feet of the user upon the pedal surfaces 19*a* and 21*a* will be either with the lower ends 19*b* and 21*b* of the pedals 19 and 21 contacting the upper surface of the base 11 or with the lower ends 19*b* and 21*b* of the pedals 19 and 21 held a certain distance above the upper surface of the base 11. It will be understood that if the lower ends 19*b* and 21*b* of the pedals 19 and 21 are maintained above the upper surface of the base 11 when the feet of the user are securely placed from a sitting position upon the upper surfaces 19*a* and 21*a* of the pedals 19 and 21, that an opportunity for the user of the exercise and toning device to rock their toes upwardly or forwardly and their heels downwardly, to desirably flex the ankles of the user and to stretch the calf muscles, is afforded. It will be noted in FIG. 1 as well as FIGS. 2 and 2A, that the pivot point or position of the pivot rod 17 with respect to the base 11 is displaced somewhat toward the near or rear portion of the apparatus 10 in order to afford a steeper angle of the pedals 19 and 21 when the foot of the user is rocked rearwardly. This is because the extreme extension of the average foot, when rocked to the rear, will tend to bring the angle of the entire foot to a higher angle than perpendicular to an axis passing parallel to the extended position of the leg of the user. On the other hand, in most instances, the completely extended angle of the entire foot in the opposite direction is not greater than parallel to an axis passing through the extended leg of the user, except in unusually supple individuals. Since the exercise device 10 will normally be placed on the ground surface or ground plane at a distance from the user at which the foot placed lightly upon the pedals 19 and 21 feels most comfortable, and since the exercise apparatus itself has a height which will tend to lift the outer end of the leg of the user higher than it might normally be placed upon the ground surface, and since, in the basic embodiment of the apparatus, the pedals 19 and 21 are freely rotatable on the pivot rods or rod 17, the apparatus 10 will normally be pushed by the user out to a position farther away from the user than the foot would normally be placed upon the ground surface without the exercise apparatus. This will automatically tend to extend the entire leg of the user so that the foot is normally in a position somewhat extended with respect to the leg somewhat as if the foot were being placed upon a foot rest or hassock in front of the user. Because, therefore, the foot is already extended in its normal position upon the pedals 19 and 21, the major movement available in the usual case is to the rear, tending to pivot the rear surface or rear end 19*b* and 21*b* of the pedals 19 and 21 downwardly toward or against the top of the base 11 of the apparatus 10. Meanwhile, extension of the foot forwardly to its maximum will tend to be less and, in fact, if the device is pushed out to a point where the leg of the user is more or less completely extended, as may appear particularly if the user reclines in the seat as many users are inclined to do, particularly if they are in the seat for long periods of time, the relative rotation of the foot of the user will be much less toward the front and will tend to bring the foot almost parallel to the upper surface of the base 11 rather than rotated downwardly against its top surface, while the rear rocking of the foot will tend to bring the pedal to an angle at which the pedal is brought more than perpendicular to the normal axis through an extended leg. This relationship is shown in FIGS. 2B and 2C in which 2B shows diagrammatically the normal leg and foot position of a human FIG. 30 seated in a typical chair such as a castor-type office chair 32, with the feet of the user placed upon the ground or normal plane surface 34 upon which the chair 32 also rests. FIG. 2C shows diagrammatically the same position of the human body 30 with the foot or feet 38 of the user placed on the pedals 19 and 21 of an apparatus 10 in accordance with the invention and in which it is seen that the normal comfort foot range is about 15 or 20 degrees of an angle of about 5 degrees upwardly with respect to an imaginary line perpendicular to an axis parallel to the length of the lower leg of the user. The exercise range of the foot will be for the usual or typical person using the device, from about parallel with the leg of the user to about 100 degrees to 115 degrees beyond to a line parallel to the axis of the lower leg of the user, or in other words, between 10 and 25 degrees beyond perpendicular to a line parallel to the lower leg of the user. More particularly in FIG. 2B, a stick FIG. 30 is shown diagrammatically seated in a typical work chair 32 shown placed upon a ground or plane surface 34. The lower leg 36 of the stick FIG. 30 extends downwardly to the foot 38 of the figure shown diagrammatically placed upon or parallel to the ground surface 34. This is the normal position of a person sitting in a typical chair 32. FIG. 2C, on the other hand, diagrammatically shows a stick FIG. 30 seated in a chair 32 upon the ground surface 34 with the foot 38 of the stick figure placed upon the upper surface of a pedal 40 of an exercise device 10 such as shown in FIGS. 1 through 3. The base 11 of the exercise device 10 is shown placed upon or parallel to the ground surface 34. Since the exercise device itself has a certain height 40, it will be seen that the lower leg 36 of the FIG. 30 will be normally positioned at a lesser angle or more acute angle with respect to the ground surface 34 and the foot 38 of the figure will be more nearly parallel with the lower leg 36. See Section or Sequence I of FIG. 2C. This is actually a more relaxed position, since it more closely approaches the position which the leg and foot would assume if they were being supported upon a conventional footrest or hassock. In rocking the foot 38, therefore, in order to exercise the muscles in the foot and the calf as well as other muscles in the lower leg, the foot 38 will be rocked rearwardly to an angle as shown in the second section or Section II of FIG. 2C in which the foot 38 and the pedal 42 are rocked backwardly or rearwardly until the foot is slightly more than perpendicular to a line 44 parallel to the axis of the leg 36 or approximately 10 to 25 degrees upwardly from or beyond perpendicular to the axis of the lower leg. In the third section or Section III of FIG. 2C, the foot 38 of the FIG. 30 is shown rocked forwardly or downwardly to the front with the pedal 42 until the angle of the pedal 42 and foot 38 are nearly parallel to the line 44 which is parallel to the axis of the lower portion of the leg or, in other words, until the foot 38 is essentially parallel to the axis of the lower portion of the leg 36. The angle, therefore, between the maximum rocked-backward position of the foot on the pedal 42 is, as shown diagrammatically in the last section or Section IV of FIG. 2C, essentially the angle 46 which, if measured, would be found to be approximately 110 to 115 degrees for the usual person, or in exceptional persons, up to 125 degrees, maximum difference in pronation of the foot between maximum rocked-back position and maximum rocked-forward position. The several consecutive positions of the feet or foot of the stick FIG. 30 and the final maximum difference in angles shown diagrammatically in FIG. 2C are designated in the figure by Roman Numerals I through IV, placed directly below the various stages shown.

The length of the foot contact and support means, or pedal or pedals of the apparatus should preferably not be much greater than the length of the foot of the person using the apparatus, particularly in the rear, in order not to limit the range of movement or pivoting of the pedal any more than necessary. However, as a practical matter, the length of the foot contact and support means will be made to be approximately as long as the foot of the largest averaged dimensioned person who is likely to use the device. Pedals for men or women may be supplied and the pedal may be imagined to include a heel and ball of the foot contact portions which in some cases will actually be delineated upon the pedal, but in most cases will be purely imaginary.

As indicated briefly above, FIG. 2 is a partially broken-away diagrammatic side elevation of the exercise device shown in FIG. 1 with the side 15 partially broken away to show, in particular, the pivot rod fitting 25 and the fitting fastenings 27 which together secure the pedal 21 as well as the pedal 19, not shown, to the pivot rod 23.

FIG. 2A is a diagrammatic view of the arrangements shown in FIGS. 1 and 2, but in which an additional portion of the side wall 15 has been partially cut away and the pedal 19*a* is turned with its farther end downwardly near the base 11 while the pedal 21 remains in the same position as shown in FIG. 2 with the rear or nearest end to the user rocked downwardly to adjacent the base 11.

FIG. 3 is an end elevation of FIG. 2A showing the pedals 19 and 21 positioned in the same arrangement as in FIG. 2A. The pivot rod fittings 25 and their fitting fastenings 27 are also clearly visible on the lower side of the pedal 19 in FIG. 3.

Figure 4:
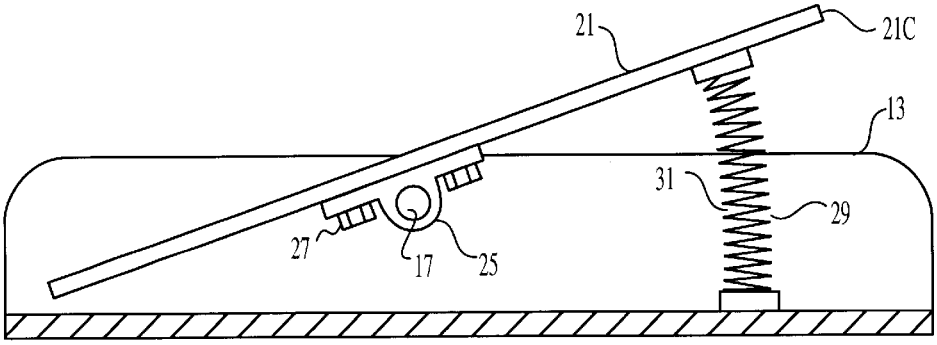
FIG. 4 is a side elevation of an alternate embodiment of the invention in which the rocking pedals are provided with a resilient means positioned at the far end of the pedal to provide additional resistance to movement of the pedal, the resistance being, in the instance shown, provided by a coil spring-type resistance.

FIG. 4 is a partially broken-away side elevation similar to FIG. 2 in which a resistance means broadly designated as 29 is shown positioned on the far end of the pedal 21. The resistance means 29 is shown more particularly in FIG. 4 as being a coil spring-type resistance having a series of interconnected coils 31 which, when pressed together or towards each other, allow the far end 21*c* of the pedal 21 to be forced downwardly toward the base 11 and in that manner providing resistance against the movement of the foot of the user to provide additional exercise, particularly to the calf muscles in rotating the foot downwardly against the resistance of the coils 31 of the resistance 29.

Figure 5:
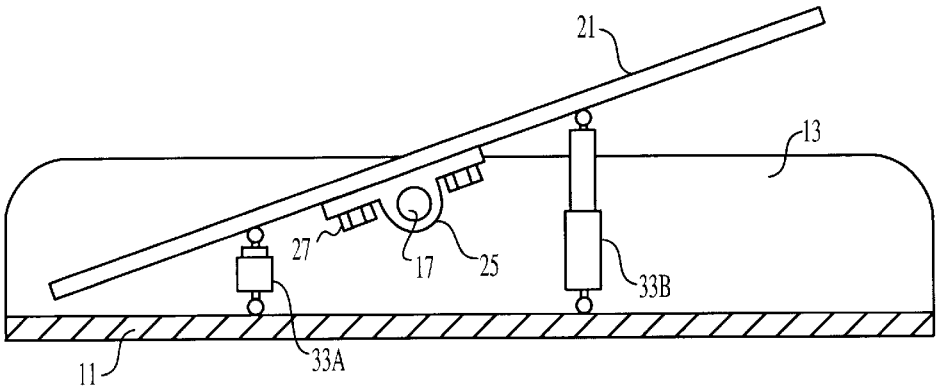
FIG. 5 is a side elevation of a still further embodiment of the invention in which the pedals are provided at both ends with additional resistance to movement of the pedal, in this instance fluid cylinder-type resistance.
Figure 6:
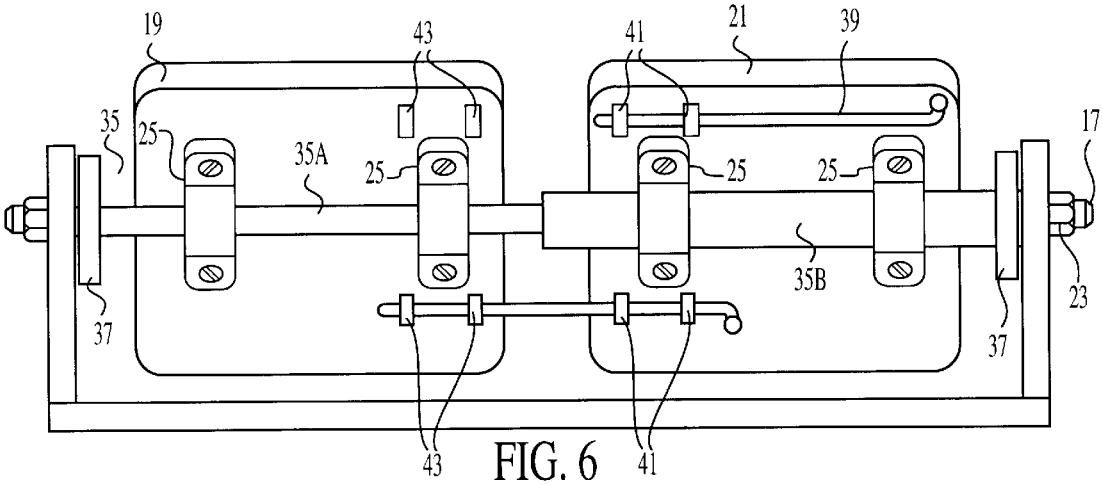
FIG. 6 is an end elevation of an embodiment of the invention in which the two pedals are provided with separate flat coil spring means to resist rocking and the pedals may, if desired, be secured together to provide coordinated movement.
Figure 6A:
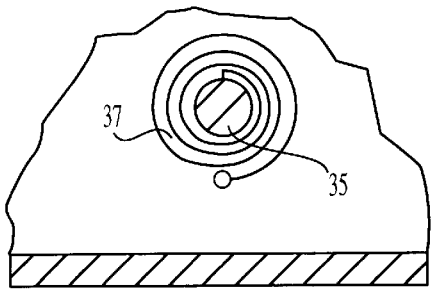
FIG. 6A is a partial side view of one of the flat coil spring arrangements about the axle of the pedals to provide resistance against rocking.

FIG. 5 is a diagrammatic side elevation similar to FIG. 4, but showing two resistance means 33*a* and 33*b* positioned in contact with the lower side of the pedal 21 and the upper surface of the base 11 in a position such that the resistance 33*a*, which is shown in the form of a fluid pressure cylinder, will resist rocking of the pedal 21 downwardly toward the rear or near end of the exercise apparatus and pressure cylinder 33*b*, will particularly resist movement of the farther end of the pedal 21 toward the base 11. The two resistance means 33*a* and 33*b*, therefore, act together to provide resistance to the movement of the pedal at all times. Such fluid resistance cylinders means may be either single acting or double acting and are shown diagramatically merely to illustrate that various resistance means or resilient resistance means may be used to resist movement of the pedals and therefore provide additional resistance against movement of the muscles of the user's body to provide additional exercise. FIGS. 6 and 6A show a further arrangement for providing resistance to the movement of the pedals 19 and 21. In FIG. 6, there is shown an end view of a diagrammatic representation of an exercise apparatus in accordance with the invention in which the two pedals 19 and 21 are journaled on separate concentric sections of a single pivot rod mounting 35. The pivot rod 35 as a whole is formed from the inner pivot rod 35*a* upon which the pedal 19 is secured and outer pivot 35*b* to which the pedal 21 is attached. In this case, the two pivot rod sections 35*a* and 35*b* are themselves journaled in the side walls 13 and 15 so that the pivot rod as a whole rotates and the two sections 35*a* and 35*b* rotate independently concentric with each other. The pedals 19 and 21, furthermore, in this embodiment of the invention, are attached rigidly to the two pivot rod sections 35*a* and 35*b* so that the entire assembly, including the pedal and the portion of the pivot rod upon which it is mounted, rotate or rock back and forth as a unit which is in fact journaled in the end walls 13 and 15 in any suitable bearing arrangement which may be merely a lubricated orifice and rotating arrangement or actual ball bearings or roller bearings or other suitable bearing arrangement not specifically shown. At the ends of the two concentric pivot rod sections 35*a* and 35*b*, there are shown coil spring assemblies 37 which are attached in the center to the pivot rods 35*a* or 35*b* and at the outside to the adjacent side walls 13 or 15 such that when the pivot rod sections 35*a* or 35*b* rotate, the spring elements 37 will be either tightened or loosened, depending on the particular rotation of the pivot rod sections 35*a* or 35*b* and the rotation of such pivot rod sections is therefore resisted and through such resistance of the pivot rod sections, the resistance of the foot pedals 19 and 21 to movement of the feet of the the user is provided. As will be seen, therefore, the arrangement shown in FIGS. 6 and 6A provides a convenient and efficient arrangement for securing independent resistance against rocking or rotational movement of the two pedals independently in order to provide additional exercise to the lower portions of the legs and the feet of the user. There is also shown in FIGS. 6 and 6A, two latching means for securing the two independently-acting foot pedals together in case it is desired to operate essentially in a single foot pedal mode, or with what is in effect, a single foot pedal acting in unison with respect to the two feet of the user and, in this case, obtaining twice the resistance to movement of the two pedals as will be obtained with respect to one pedal. To this end, a straight securing means, or pins, are shown mounted on the lower portions of the pedals 19 and 21 in loops or fittings 41 in which the pins 39 slide and align with similar loops or pin fittings 43 on the underside of the opposite pedal, in this case pedal 19 into which the end of the pins 39 may be slid to, in effect, lock the two pedals 19 and 21 together for coordinated movement rather than independent movement as is obtained when the pins 39 do not extend between the two pedals. In FIG. 6, the upper pin 39 on the nearer portion of the pedal 21 is shown retracted from the loops 43 so that this portion of the pedals 19 and 21 are not secured together, while the lower pin 39 is shown pushed through the loops 41 and 43 on both pedals 19 and 21 so that the farther or outward portions of the pedals 19 and 21 are temporarily locked together. It will be understood that the pins 39 are shown in both the locked and unlocked positions in FIG. 6 merely to illustrate the two positions and that normally the pins will either be withdrawn from interengagement with the two separate pedals or will be thrust into engagement with the two pedals on both sides of the pedal so that the pedals are, if they are to be locked together, securely interlocked together, and if they are not to be interlocked together, are not secured together at all. It will be understood that the arrangement for locking the two pedals together is merely a simply illustrative arrangement showing that locking together the pedals may be effected and it will be understood that there are many other ways of interlocking the pedals of which the one shown is one of the simplest, although not necessarily the most convenient for the user of the apparatus.

Figure 7:
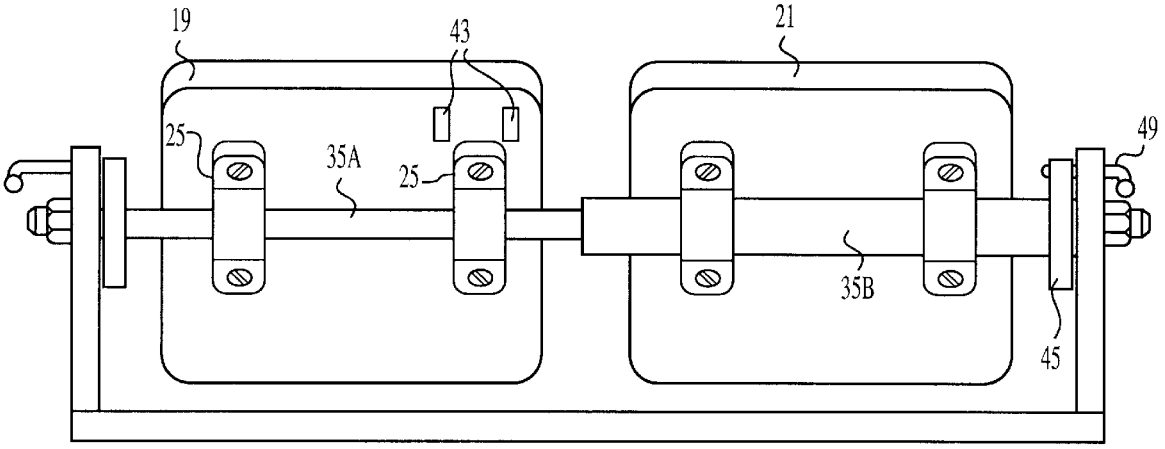
FIGS. 7 and 7A are an end view and a partial axle view of an embodiment of the invention constructed to provide or allow the rocking pedal exercise machine to be used as a simple footrest upon the election of the user.
Figure 7A:
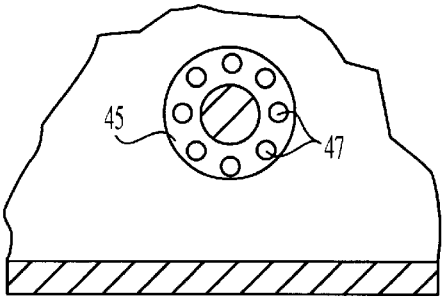

FIGS. 7 and 7A are diagrammatic illustrations showing a somewhat similar arrangement of the pedals 19 and 21 upon the pivot rod or concentric pivot rods 35*a* and 35*b* which, however, rather than having spring resistant arrangements at the two ends, have instead attached to such concentric pivot rods to which the steps or pedals 19 and 21 are permanently secured independent locking members 45*a* welded or soldered to the pivot rods so that such circumferential locking members 45 are, in effect, integral with the pivot rods 35*a* and 35*b*. The locking members 45 have a series of locking orifices 47 which extend through such locking members and provide openings for locking pins 49 which may extend through orifices, not shown, in the side walls 13 and 15 at both sides of the pivot rods 35*a* and 35*b* and immobilize the locking members 45 by extending through the locking orifices 47 in such members. Since the pedals 19 and 21 are secured directly to the two pivot rods or concentric pivot rods 35*a* and 35*b*, immobilization of the pivot rods 35*a* and 35*b* by the pins 49 extending through the orifices in the locking members 45 effectively immobilize the pedals in any position desired by the user to immobilize the pedals as foot rest members. It will be understood that the arrangements shown in FIG. 7 and 7A are merely one fairly simple embodiment of locking arrangements whereby the foot pedals 19 and 21 may be immobilized in a position in which the user wishes to use them as mere foot rests rather than exercise means.

Figure 8:
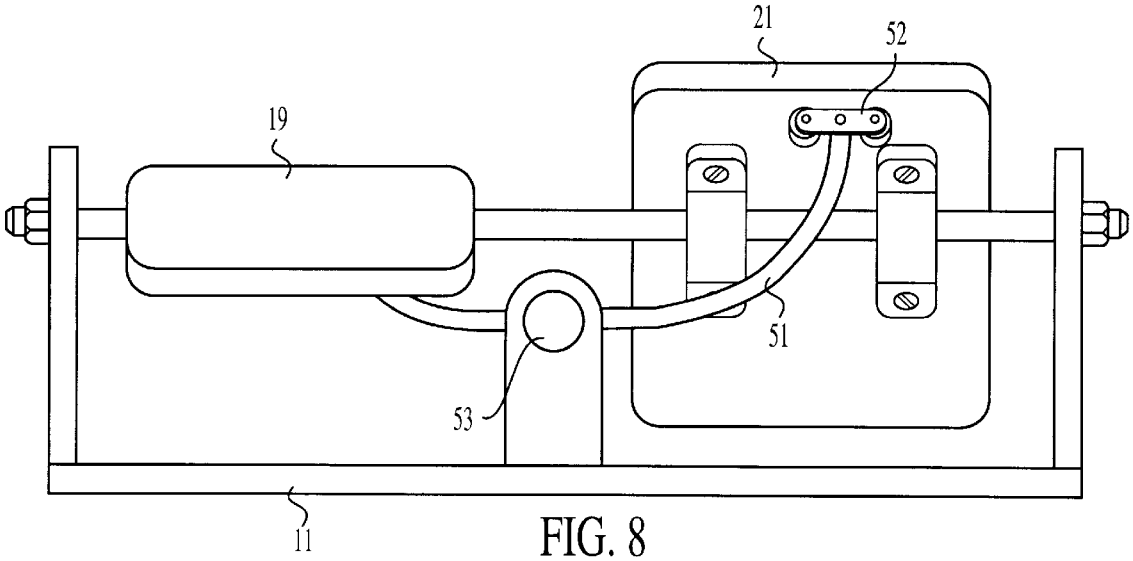
FIG. 8 is an end elevation of an embodiment of the invention in which the two pedals are coordinated together by a lever-type connection so that they rock alternatively, one pedal being depressed as the other pedal rises.

FIG. 8 is a diagrammatic end view similar to FIG. 3 in which the two pedals 19 and 21 are shown inclined in different directions about the pivot rod 17. In FIG. 8, a coordinating arm 51 is shown pivoted at 53 and extending into contact with the lower portion of each pedal 19 and 21. A pair of rollers 52 are journaled on the ends of the arm 51 to allow such ends to move easily in contact with the bottoms of the pedals as shown in FIG. 8. It will be understood from FIG. 8, that when pedal 19 is pushed downwardly, as is shown for the nearer portion in FIG. 8, the coordinating arm 51 will be raised on the right side under pedal 21 and will cause the nearer portion of pedal 21 to rise while the farther portion of pedal 21 will be pressed downwardly. In the arrangement shown, therefore, the two pedals are coordinated in a very simple mechanical manner so that one will necessarily rock in one direction while the other is rocking in the opposite direction. This may be convenient to some users who lack coordination in their feet or movements of their feet. However, it also enables the users themselves to place varying degrees of pressure upon one pedal or resistance to movement upon one pedal dependent on the resistance placed on the other pedal with the other foot. A form of dynamic tension in which one portion of the body, in this instance one of the feet, is arranged to act against another portion of the body, in this instance the other foot, so that the body of the single user is itself providing the tension or pressure on the exercise device to exercise different parts of the body is thus provided. These dynamic tension arrangements are often a simple way to provide additional tension in an exercise arrangement. However, as will be realized, the arrangement is merely an illustration of one way in which the two portions of the apparatus may be coordinated together and it will be understood that other arrangements may also be used without departing from the invention and that the particular arm arrangement shown is already known in the art for the normal stepping-type exercisers, see for example, the disclosure of U.S. Pat. No. 5,256,118 noted above, in which ultimate climbing or stepping motions are made alternately by the two legs of the user. Thus FIG. 8 merely illustrates the breadth of the present invention and the fact that the two pedals may be coordinated for opposite movement if desired. In most cases, however, due to the type of exercise which is being sought, in accordance with the present invention, it is usually found more beneficial for the user to be free to move the two pedals independently so that the user can, in fact, vary the pattern of rocking between the two feet, securing an additional variation and relaxation due to a less uniform movement. Furthermore, most users will fall into their own pattern of coordinated movement with which they feel particularly comfortable and the amount of exercise provided to the muscles involved will be essentially the same in any case.

Figure 9:
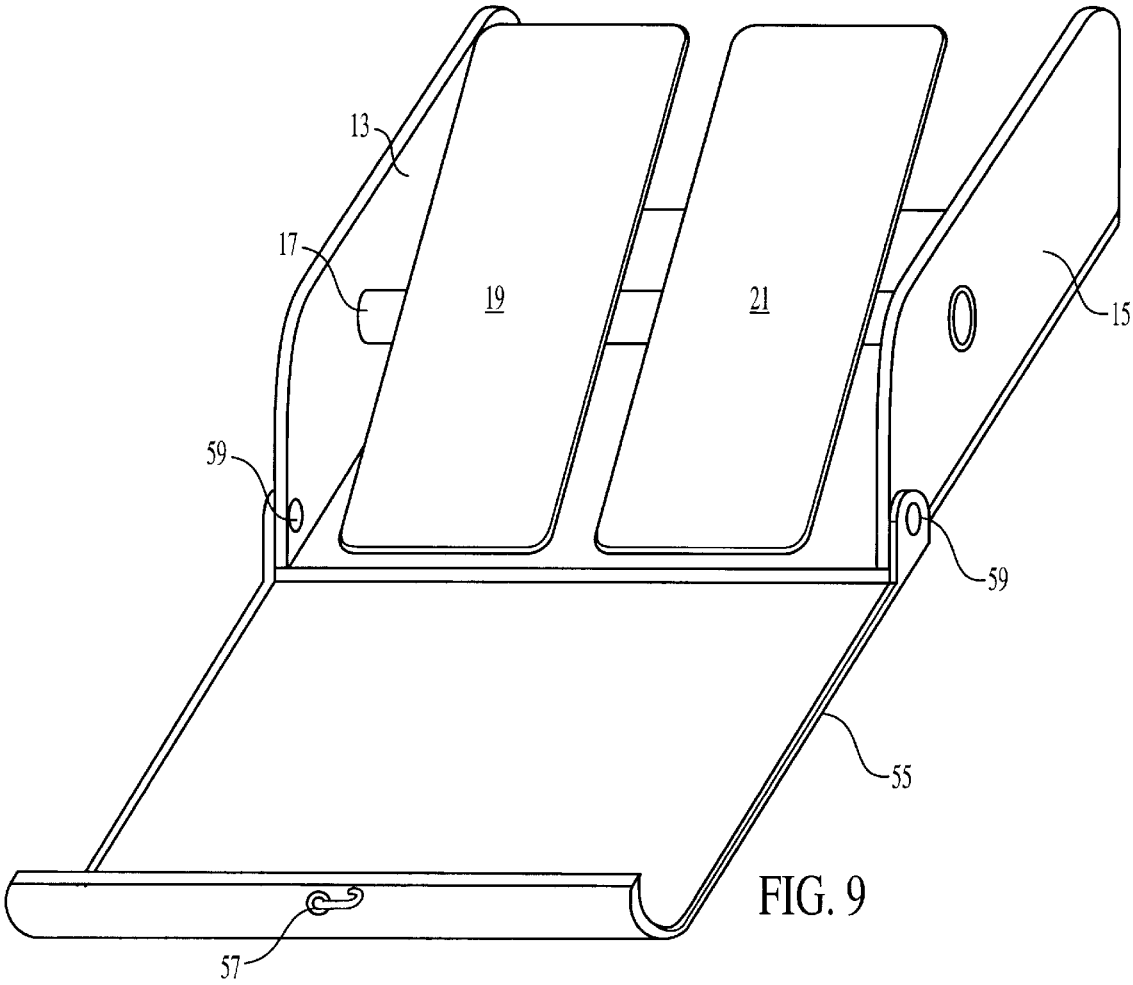

FIG. 9 shows a further version of the invention in which the entire apparatus 10 is provided with a cover 55 which may be swung up to enclose the apparatus when not in use to make it, in particular, portable for use away from home or the like, for example, in an automobile, or bus or in an airplane during long trips when circulation in the legs may become stagnant. A latch 57 is provided to interact with another latch, not shown, at the opposite end of the apparatus to hold the cover 55 over the apparatus during transportation and the like. Pivot pins 59 are provided for pivoting of the cover 55 to the side walls 13 and 15.

Figure 10:
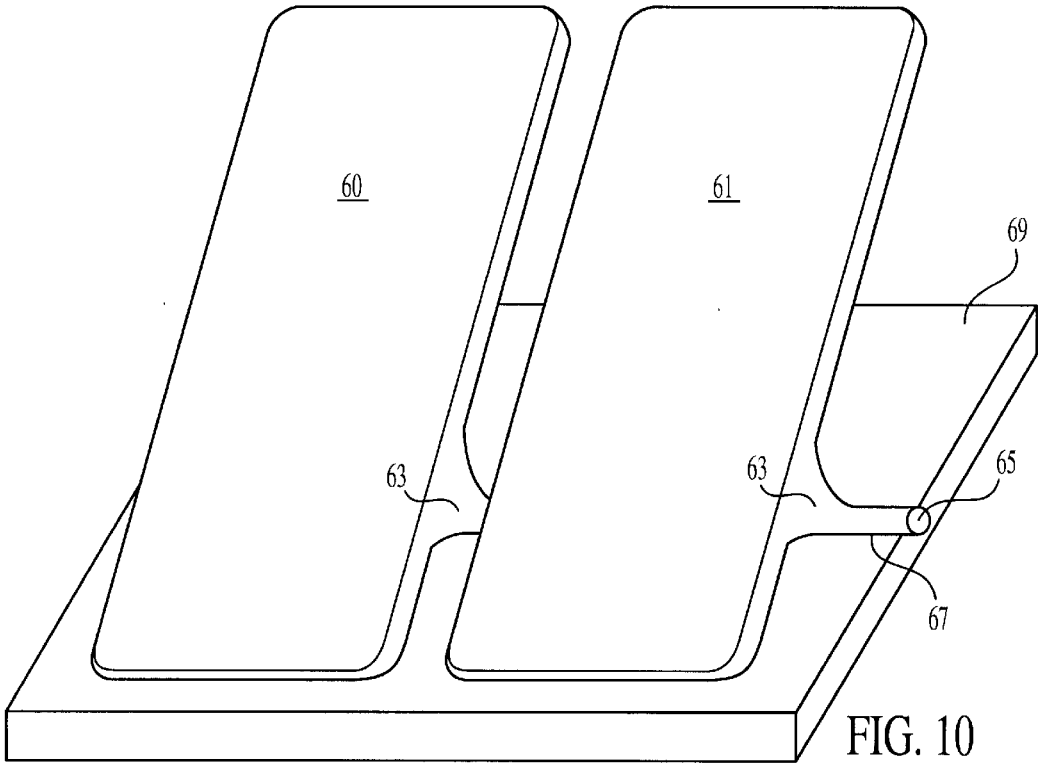
FIG. 10 is an isometric view of an alternative embodiment of the invention particularly adapted for construction of a plastic resin material in which the pivot point of the pedals has been moved farther from the surface of the pedal, in the case shown, essentially to the surface, or just below the surface, of the base.

FIG. 10 shows a further embodiment of the invention in which the pivot point of the pedals, in this case enumerated as pedals 59 and 61, are provided with a unitary pivoting arrangement in which there is no separate pivot rod, but instead, an extension 63 on the lower portion of the pedals 59 and 61 upon which extension there is molded a cylindrical pivot support 65 which matches with a cylindrical pivot groove or channel 67 which is semicircular so that it partially encompasses the pivot support 65 to prevent such pivot support from leaving or slipping out of the pivot groove or channel 67 in the base 69. The base 69 may have a series of short, outward extensions 71 on the lower surface which provide roughness to such lower surface which will tend to interact with a heavy carpet or the like, and prevent the base 69 from sliding along the support or ground surface. See FIG. 11 which is a side elevation of FIG. 10. It will be understood that the extensions 71 are merely examples of rough or uneven surfaces which may tend to grip the ground surface or ground plane upon which the exercise apparatus will normally be placed.

Figure 11:
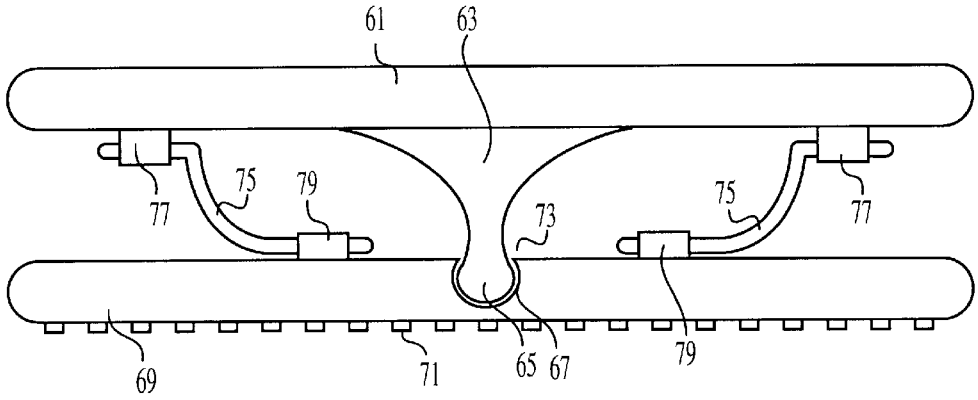
FIG. 11 is an enlarged side elevation of the embodiment of the invention shown in FIG. 10.

FIG. 11 is an enlarged side elevation of the arrangement shown in FIG. 10 in which the pivot support 65 may be seen contained within the pivot groove or channel 67 in the base. It will be noted that the upper portion or opening 73 along the top of the pivot groove 67 is narrower than the extreme diameter of the pivot support 65 so that once the pivot support 65 is inserted into the pivot groove 67 from the side, the pivot support 65 cannot be withdrawn from the pivot groove 67 except again from the side. The pivot support 65 is held upon the end of the extension 63 and the width of the extension along the top of the pivot support 65 is such that a significant clearance is provided between the side of the opening 73 and the extension 63 so that the extension 63 may be rocked from side to side without contacting the edges of the opening 73 allowing the pedal 61, which is mounted upon the upper portion of the extension 63, to rock from side to side in accordance with pressure placed upon its surface by the feet of the user. In FIG. 11, there are also shown flexible spring strips 75 which are secured to the pedal 61 by fastening loop 77 and to the top of the base by a similar fastening loop 79. As will be seen, since the flexible strips, which may be comprised of either spring material, i.e. a metal spring-type material, or a flexible plastic strip having sufficient resiliency and fracture resistant to act as a spring strip which serves to resist bending and therefore tends to hold the underside of the pedal 61 away from the upper side of the base 69, such flexible strips serve as an effective rocking resistance medium for the exercise apparatus. In this way, the exercise apparatus structure is arranged such that a force must be applied to the surface of the pedals 59 and 61 to cause them to rock so that first one and then the other end approaches the surface of the base 69. As noted before, the bottom of the base 69 is provided with slight extensions of the surface which serve, in effect, to roughen the surface and provide additional gripping with whatever ground surface the bottom of the base 69 is likely to be set upon. It will be understood that the square-type arrangement shown in FIG. 11 of the enlargements 71 on the base 69 is only one type of roughening of the surface of the base and that various other arrangements may be used to obtain a discontinuous or rough base which may tend to grip the surface upon which the base 69 is placed. For example, a square or even circular pattern of slight extensions may be very effective when placed upon a pile rug or the like to prevent slippage of the base, while if the base was to be placed upon a wooden floor or the like, it might be desirable to provide rubber extensions or even metal extensions having points upon the ends to obtain a better grip. Since the feet of the user are actually placed on top of the pedals and then the feet rocked to obtain the exercise inherent in operation of the device, rather than pressing the device from the side, there is less tendency of the base to slide upon the ground surface than there might otherwise be.

Figure 12:
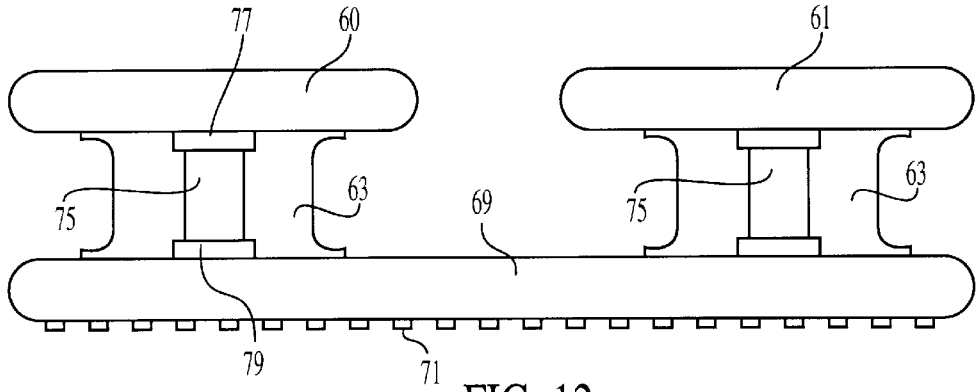
FIG. 12 is an end view of the embodiment of the invention shown in FIGS. 10 and 11 which alternative embodiment may also be formed from a plastic resin material.

FIG. 12 is an end view of the embodiment of the invention shown in FIGS. 10 and 11 in which the extension 63 on the bottoms of both the pedals 59 and 61 may be clearly seen along with the spring strips 75 which serve to provide resilient resistance against rocking of the pedals 59 and 61 upon the base 69 as may be seen by a comparison of FIGS. 11 and 12. The extensions 71, which it will be understood may be either centrally square or circular, are more or less evenly distributed over the bottom of the base 69. The apparatus shown in FIGS. 10–13 is particularly adaptable for molding from a plastic resin composition, while the apparatus shown in FIGS. 1 through 9 is particularly adaptable for construction from metal, wood, hardboard and the like.

Figure 13:
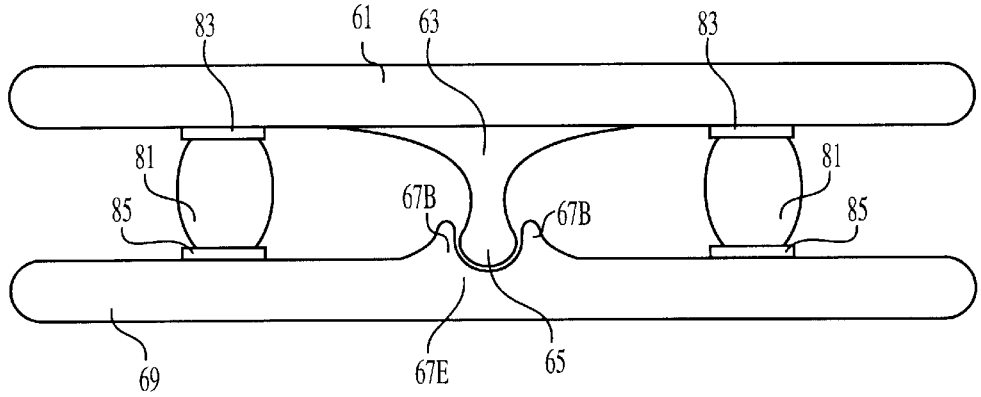
FIG. 13 is an enlarged side elevation of an alternative version or embodiment of the displaced pivot version of the invention shown in FIGS. 10 through 12, which alternative embodiment may also be formed from a plastic resin material.

FIG. 13 is a side elevation of a further embodiment of the invention in which a similar rocking arrangement is provided as in FIGS. 10 through 12 with the pivot support 65 journaled within a pivot groove 67*a* which, in this case, rather than being an actual groove in the base, is a groove partly in the base and partly comprised of overlapping portions 67*b* which together form an enclosed groove 67*a* in which the pivot support 65 is journaled. As may be seen in FIG. 13, the pivot support 65 may be slid into the pivot groove 67 from the side just as it was in FIG. 11, the only essential difference between the pivot arrangement of the two embodiments being that the pivot arrangement of the embodiment of FIG. 13 is partially embedded in the base and partially secured upon the surface of the base, in effect, moving the pivot point of the pedal 61 closer to the pedal rather than into the base 69. Another difference between the embodiments shown in FIG. 11 and FIG. 13 is that in FIG. 13 the resilient means which tend to keep the pedal from approaching the surface of the base 69 comprise resilient elastic members such as rubber sections 81 which are held at both ends in mounting rings 83 and 85 respectively on the surface of the pedal and the surface of the base. Such resilient members 81 may, for example, be in the form of somewhat egg-shaped sections of natural or synthetic rubber or may be inflated egg-shaped sections or may take several other forms of polymeric substance serving as a resistance means to discourage close approach between the lower surface of the pedal and the upper surface of the base.

Figure 14:
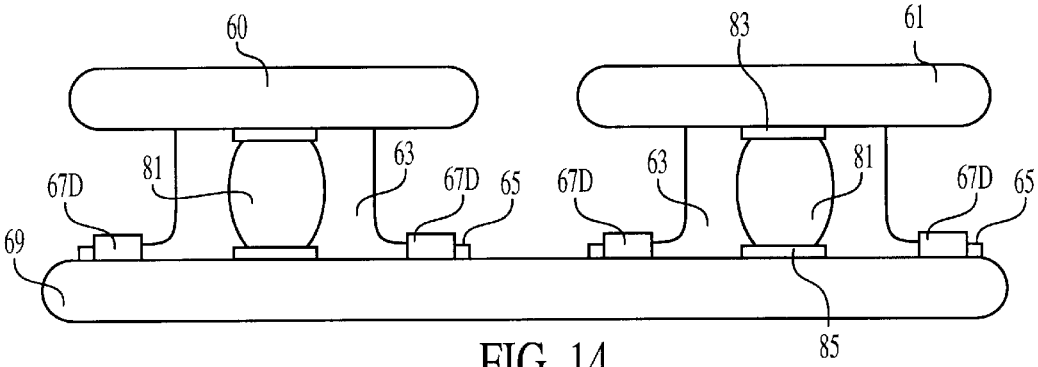
FIG. 14 is an end view of the alternative embodiment of the invention shown in FIG. 13.

FIG. 14 is an end view of the embodiment of the invention shown in FIG. 13 in which it may be seen that the enclosing member 67*b* is somewhat different than shown in FIG. 11. For example, in the embodiment shown in FIGS. 13 and 14, the extension 63 will be seen, as shown in FIG. 14, to extend upwardly to the bottom of the pedals 59 and 61 only in the center of these pedals and the enclosing members 67*b* only extend over the pivot supports 65 at the ends of such pivot supports away from the extensions 63 so that the enclosing members 67*b* can fit more closely about the top of the pivot support 65 without preventing pivoting of the pedals 59 or 61. In such arrangement, the pedals 59 and 61 will still pivot, since upon pivoting to either side, the extensions 63, which are spaced between the enclosing members 67*a*, pass downwardly about said members at a different point and there is no interference between the rocking of the pedals 59 and 61 and contact of the extensions 63 with the top of the enclosing members 67*b*.

Figure 15:
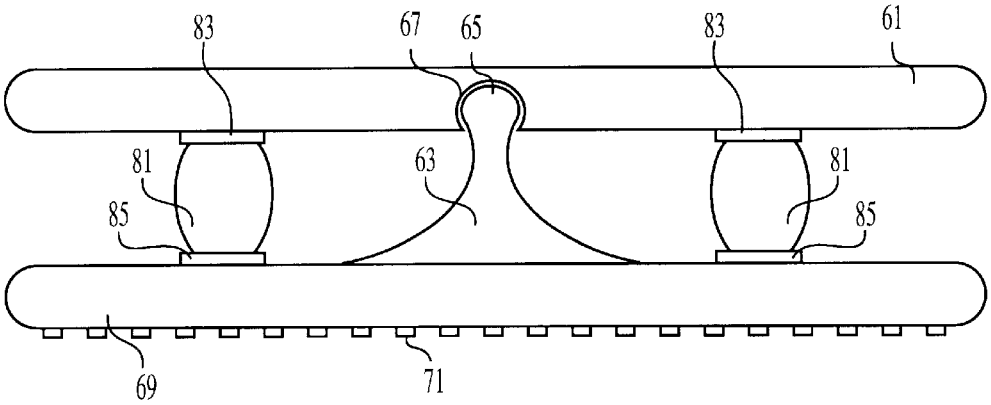
FIG. 15 is an enlarged side elevation of a still further embodiment of the invention in which the pivot point of the pedals is within the structure of the pedals themselves, which embodiment may also be readily formed of a plastic resin material.

In FIG. 15 a somewhat reversed version of the embodiment of the invention shown in FIGS. 10 and 11 is shown in which the pivot support 65 supported on extension 63 is embedded within the pedal structure 61 rather than within the structure of the base 69. In other words, as shown in FIG. 15, the pivot support 63 is supported directly upon the base 69 by the extension 63 and the pedal is fitted over the pivot support 65 in a pivot groove 67 within the actual structure of the pedal 61. The same arrangement of resilient members which resist pivoting of the pedal 61 with respect to the base 69 is shown in FIG. 15 as shown in FIGS. 13 and 14. As will be understood, the movement of the pivot point of the apparatus into the actual structure of the pedal 61 or 59 is essentially one extreme limit of the pivot point or, in other words, near the ultimate extreme of having the pivot point directly upon or adjacent to the pedal, while the embodiment of the invention shown in FIGS. 10 and 11 is the other extreme of having the pivot point moved away from the pedal 61 either adjacent to the base essentially as shown in FIG. 13 or actually into the base as shown in FIG. 11 and is essentially at or near the ultimate limit of moving the pivot point away from the pedal itself. In both cases, however, it will be noted that the pivot support which serves as the pivot point of the entire pedal apparatus is still mounted near the central portion of the pedal from one end to the other, rather than near the end of the pedal, which position provides a different movement. In general, it may be said that in order to have a rocking motion exerciser for exercising the lower limbs, the pivot point should be provided in the central portion of the apparatus preferable somewhat toward the rear of the pedal and should be preferably in or adjacent to the portion of the pedal extending from approximately one quarter of the distance from the rear of the foot position on the pedal to one half of the distance from the rear of the foot position on the pedal to the front of such foot position. As explained in more detail below, this will be true with respect to any foot placed centrally from front to back on the pedal, and if the pedal is approximately the same length as the foot of the user, such range of pivot position may as a practical matter be measured from the rear of the pedal. If such position of the pivot point of the pedal is used the user will obtain the gentle, soothing rocking motion desired in the apparatus. Moving the pivot point beyond the central portions will tend to unbalance the entire apparatus and to prevent the soothing rocking motion which has been found to be particularly appropriate for the treatment of injuries to the lower extremities.

Figure 16:
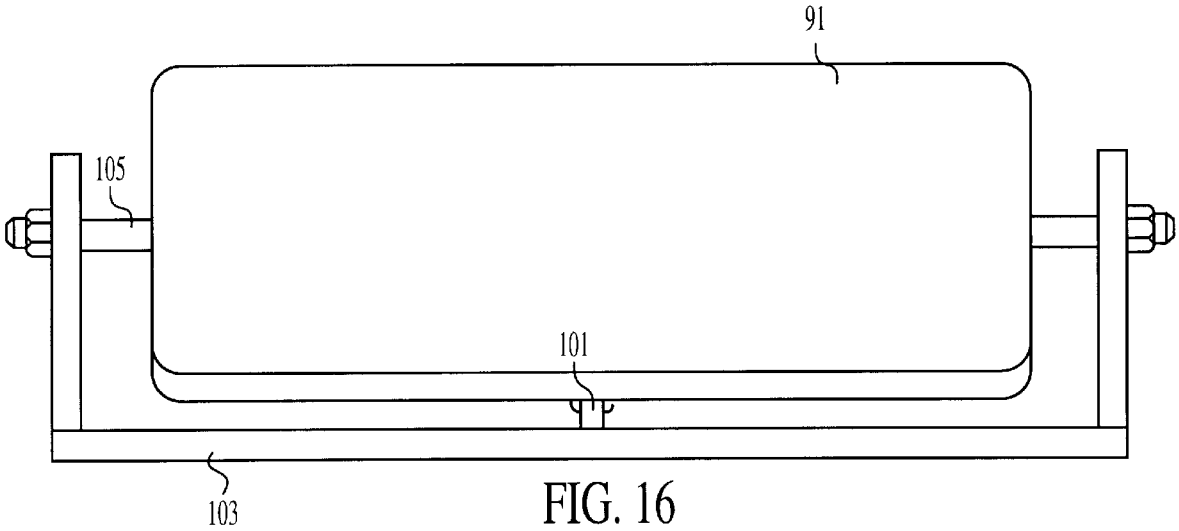
FIG. 16 is an end view of a single pedal embodiment of the invention with an alternative arrangement for providing resilience to movement of the pedal.
Figure 17:
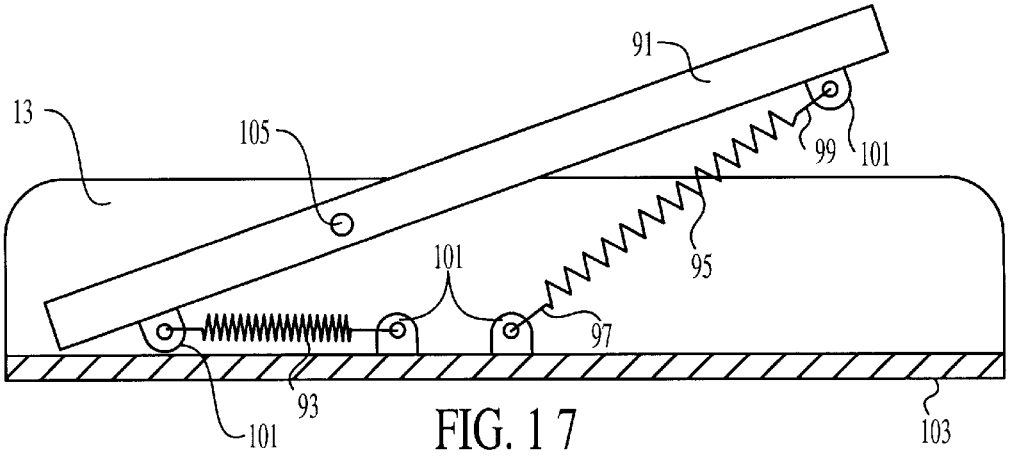
FIG. 17 is a longitudinally sectioned side elevation of the embodiment shown in FIG. 16.

FIGS. 16 and 17 show diagrammatically, in a longitudinally sectioned view in the case of FIG. 17, a further version of the invention in which there is only a single pedal 91 which is somewhat analogous to the locked together, or potentially locked together version of a two pedal device shown in FIG. 6. The pedal 91 is fairly thick and accommodates an internal pivot rod 105 about which the pedal pivots. FIG. 16 shows a front elevation of the single pedal device while FIG. 17 shows the single pedal 91 device from the side plus a further arrangement for the application of resilient spring tension to the pedal to render its movement resilient. In such arrangement springs 93 and 95 are attached by bar extensions 97 and 99 to the outer lower portions of the pedal 91 as well as to short posts or the bollards 101 mounted upon the base 103 near the center of the device. As the pedal 91 is rocked on its pivot rod 105, one or the other of the springs 93 or 95 are extended. As noted above, in this particular embodiment the pivot rod 105 passes directly through the center of pedal 91, which is in turn made fairly thick to accommodate the diameter of the pivot rod 105. The arrangement and size of the springs 93 and 95 shown in FIG. 17 has the advantage of providing a fairly soft rocking movement of the pedal due to the longer tension springs as compared to previously illustrated devices.

FIGS. 18 and 19 are respectively diagrammatic end and partially broken away side views of a two pedal version of the apparatus of the invention in which two fluid cylinders 107 and 109 are substituted on the two separate pedals 91*a* and 91*b* for the springs 93 and 95 shown in FIG. 17. One end of the fluid cylinders 107 and 109 are also attached via extension bars 97*a* and 97*b* to transverse attachment bar 111 which extends between elevated support pedestals 113 and 115 into which the pivot rod 105 is also journaled. The remainder of the reference numerals in FIGS. 18 and 19 are the same as in FIGS. 16 and 17 when referring to similar structures. The use of the support pedestals 113 and 115 rather than the side walls 13 and 15 shown in previous figures has the advantage of providing a more open structure, but requires a sturdier construction to support the pivot rod 105 securely than is required with the extended side walls shown in earlier figures. The advantage of the arrangement of the fluid cylinders in FIGS. 18 and 19 is again that a larger travel of the piston in the cylinder is available and the general feel of the resistance will consequently be somewhat different from the analogous use or arrangement of fluid cylinders shown in FIG. 5 for example.

FIGS. 20 and 21 are a front view and partially cut away side view of a further embodiment of the invention in which two pedals are shown mounted upon a pivot rod 17 as shown in FIGS. 1 through 4. Pivot rod 17 is mounted upon or along the under side of the two pedals 19*a* and 19*b*. The remainder of the arrangement is essentially the same as in FIGS. 1 through 4 except that the pivot rod is mounted in pedestals 113 and 115 as in FIGS. 18 and 19 and a different arrangement of spring biasing means is used in which coil springs 113 and 113*a* are coiled about the pivot rod 17 and caught behind support structures or buttresses 115 and 115*a*. When the pedals 19 and 21 are depressed either forwardly or rearwardly the springs 113 and 113*a* will either be compressed or allowed to extend, thus providing resistance against depression of the pedal on either end. An enlarged and simplified detail of the spring arrangement is shown in FIG. 21A with nonessential elements of the resilience impacting device deleted. This type of spring is widely used at present on screen doors and the like to close such doors. The pivot rod 17 is mounted on the bottom of the pedals 19 and 21 in order to provide a convenient spring mounting for this type of resistance spring arrangement.

FIG. 22 shows a still further embodiment of the invention in which a pedal 19 having an internal pivot rod 105 as in FIGS. 16 through 19 is used, but in which corrugated air or balloon-type spring resistance elements 117 and 119 are shown arranged to provide resistance to depression of one or the other end of the pedal 91.

FIG. 23 is an enlarged view showing an improved internal latch arrangement in which a slide bolt 121 is slidingly mounted in a groove or cut out section of one pedal 91*b* of one of the pedal exercisers of the invention opposite an orifice 123 in an adjacent pedal 91*a* and a handle 125 extending from a groove 127 over the bolt allows the bolt 121 to be slide either to connect the two pedals or to disconnect them.

FIG. 24 is a diagrammatic plan view of the foot exerciser of the invention in which an actual outline of the feet of the user is shown on top of the pedals as a guide to the placement of the feet with a scale indication on the side of the relative distance of the pivot point from the defining point or heel of the arrangement as a guide. One of the foot outlines is shown in shoe form and one in barefoot form merely as illustration. As indicated, the placement of the pivot of the pedals may be from 3/16 of the distance from the rear of the heel position of the contact and support means, i.e. the pedal, to the front toe position on the contact and support means to 9/16 of the distance from the rear of the heel position to the front toe position on the contact and support means. More preferably the pivot will be located between ¼ and ½ of the same distance and most preferably the pivot will be located between 5/16 and 7/16 of the same distance. These three ranges are shown at the side of Figure or the bottom of the figure by side by side brackets marked "a" for the widest or broadest range, "b" for the still more preferable range and "c" for the most preferable range. It will be noted that the actual pivot point in diagrammatic FIG. 24 is within each of these ranges. It will be understood that the actual foot outline may be placed directly on the pedals which is fairly conventional in various pedals or may actually be imaginary as the user of the apparatus will in any event place their feet where they conceive or imagine they would be normally placed which is as shown in FIG. 24. Thus the foot position on the pedal will normally be substantially always the same other than for the variation in actual size of feet which in general will merely affect the length of foot placement and not to any great extent its actual or relative placement on the pedal. The heel of both foot patterns 131*a* and 131*b* in FIG. 24 are designated as 133*a* and 133*b* the front of the foot patterns are designated as 135*a* and 135*b*. The pedals themselves are designated with the previously used alphanumeric designations of 91*a* and 91*b* and the pivot rod as 105 the surrounding apparatus not being included.

As explained, the designation of the pivot point position of the contact and support means or pedals of the exercising apparatus of the invention as a position within a range of distances between the back of the heel and the front of the foot of a user of the apparatus ties the position of the pivot to the most efficient location for such pivot for the provision of an effective yet mild exercise easily effected from a sitting or seated position.

As a practical matter the reference point referring to the back of the heel may be considered to be more or less coincident with the rear end of the pedal so long as the pedal is not too long, which would interfere with its ready downward pivoting unless the pivot point is raised unusually high which would in turn interfere generally with convenient and comfortable use of the device from a seated position. Normally the user of the apparatus will place their feet upon the pedal, after a little practice or experience, in the most comfortable position with respect to the pivot point to obtain a comfortable rocking position and this will be found to conform with the position enumerated above, i.e. preferably within a range of 5/16 to 7/16 from the heel position to the front of the foot or less preferably within a range of ¼ to ½ of the distance from the rear of the foot to the front or a still less preferred position of 3/16 to 9/16 of the distance from the heel to the front of the foot. After an extreme position of from ⅛ to ⅝ of the distance from the end of the heel to the front of the foot is exceeded, the practicality and comfortableness of the device for exercising from a seated position becomes less than desirable. While measuring the position of the pivot from the edge of the pedal rather than the rear of the heel of an actual or imaginary user of the apparatus will bias the calculation of the correct point. Such bias will not be serious if the pedal is about the length of the foot. If the pedal is longer than the foot and the pivot position is measured with an equal amount of pedal extension on both ends of the foot the proper placement of the pivot point will be maintained. In other words, if a foot of any reasonable length is imagined placed centrally upon the pedal and the pivot point is determined as set forth above, approximately the correct position will be attained. Furthermore, if the pedal is approximately the same length as the foot the distances can be measured from the rear of the pedal. Of course, a custom positioning can also be made for any particular user by finding the length of their foot, laying out such length on the surface of the pedal and then arranging the pivot point within the ranges specified.

It will be understood that the apparatus of the invention may be formed of various materials, depending on the particular design. For example, as indicated above, the embodiments of the invention shown in FIGS. 1 through 9 may be readily made of metal, or in some cases, even of wood and various grades of plastic. Those embodiments shown, however, in FIGS. 10 through 15, will generally be more adaptable to formation out of various types of structural-type plastic material. Combinations of materials may also be used.

In general, in the use of the apparatus shown in the foregoing drawings and figures, the feet of the exerciser are placed upon or against a contact and rocking surface which is arranged to be pivotable upon some form of pivot support or other apparatus or arrangement providing a comparable movement when pressed upon by the feet of the user. The user then alternately depresses, or presses downwardly, with the rear or heel portion of his or her feet and downwardly with the forward or toe portion of their feet. Pressing downwardly with the heels while raising the toes, if persisted in until the feet and ankles feel stretched or mildly stressed, will be found to be relaxing to the lower legs not only to one whose normal movement has been restricted by injury, but also to those merely spending a large amount of time in a seated position such as on the job or watching television or the like. When the forward or toe portion of the foot is pressed downwardly, on the other hand, the relatively large calf muscles as well as other muscles in the legs and feet participate in moving the foot aiding in particular, as explained above, in the movement of blood through and away from the legs thus avoiding stasis or pooling of the blood as well as contributing to both the tone of the muscles and a feeling of well being of the one making the movement. The more resistance offered particularly to depressing of the forward position of the exercising apparatus, normally the forward portion of a pedal of the exercise apparatus, the more exercise will be had by the participant. The advantage, in particular, of being able to rock the feet backward as well as merely forward as is more usual in other already available apparatus, is that rearward movement or rocking movement of the foot actively stretches and relaxes the muscles and ligaments in the leg before again stressing them in moving the foot in the opposite direction to contract the calf muscles. In addition, of course, there is also active exercising of the relatively small muscles in the lower legs which actively raise the forward portion of the foot relative to the leg, which muscles are seldom exercised or toned, except by some rather specialized weight-type exercise apparatus found usually only in certain commercial health-type exercise centers.

In practicing the method of the invention, therefore, the user of the apparatus of the invention or any other apparatus providing or allowing a similar movement will alternatively rock their foot against the apparatus, first raising the toe and pressing down the heel, and then raising the heel and pressing down the toes, or vice versa, in usually any rhythm that is comfortable to the exerciser. While it is true that anyone can do the same thing by extending their leg and alternately rocking the feet up and down even without an apparatus against which to rest or press the feet, the effect is completely different. In the first place, movements accomplished without any coordinating apparatus tends to become uncoordinated. In the second place, in order to properly make the movement, the feet will usually have to be raised from the floor, which position cannot be held for more than a short time by the usual individual. In the third placed, the foot usually operates while in contact with a surface, except while changing feet or stepping when either walking or running. As a result, the feet simply feel better when exercising, if they are placed in contact with a surface. Furthermore, without a suitable apparatus it is not possible to conveniently apply any contra or reverse pressure against the movement of the foot, particularly when seated. Thus it is only with a suitable apparatus that any real contra resistance to the movements of the foot can be obtained. However, as indicated, there are a number of possible variations of apparatus of which the Applicant's claimed apparatus is particularly suitable.

While the present invention has been described at some length and with some particularity with respect to several described embodiments, it is not intended that it should be limited to any such particulars or embodiments or the particular embodiment, but is to be construed broadly with reference to the appended claims so as to provide the broadest possible interpretation of such claims in view of the prior art and, therefore, to effectively encompass the intended scope of the invention.

I claim:

1. A lower extremity exercise apparatus adapted for facilitating movement of the feet and lower legs of a seated person comprising:

(a) a base, (b) at least one foot contact and support means having a length sufficient to make contact with at least the major portions of the sole of a human foot, (c) said foot contact and support means being pivotally journaled with respect to the base upon a pivot means associated with said base for relative pivotal movement between the base and the foot contact and support means and having a heel position and ball of the foot position, (d) the pivot point of said pivot means being disposed longitudinally of the foot contact and support means approximately from three-sixteenths of the distance from the rear of the heel position to nine-sixteenths of the distance from the rear of the heel position on the foot contact and support means, and (e) the pivot point of the foot contact and support means being disposed with respect to said contact and support means and base such that the angle of the foot contact and support means, when pivoted downwardly toward the base upon one end, will provide an angle of the foot contact and support means such that a seated person may comfortably rest their feet upon the upper surface of the foot contact and support means from an adjacent seated position and can move or rock the far end of the foot contact and support means downwardly with the forward portion of their foot by downward pressure from said forward portion of their foot and (f) wherein the pivot point is comprised of a combination of a substantially semi-cylindrical pivot opening in one of the base and the foot contact and support means and a semi-cylindrical pivotable support member secured to the other of the base and the foot contact and support means by an extension which pivotable support member is accommodated in the pivot opening.

2. A lower extremity exercise apparatus in accordance with claim 1 wherein the pivot point of said pivot means is disposed with respect to the foot contact and support means from one quarter of the distance from the heel position to one half the distance from the rear of the heel position.

3. A lower extremity exercise apparatus in accordance with claim 1 wherein the pivot point of the foot contact and support means is positioned with respect to the base such that pressure of a human foot upon the foot contact and support means can move a near end of such foot contact and support means downwardly from a comfortable seated position of a human body attached to such foot.

4. A lower extremity exercise apparatus in accordance with claim 1 additionally comprising:

(f) a resistance means effective to resist movement of a far end of the foot contact and support means with respect to a user downwardly to increase the exercise value of such movement to the user.

5. A lower extremity exercise apparatus in accordance with claim 3 additionally comprising:

(f) a resistance means effective to resist movement of the near end of the foot contact and support means with respect to a user downwardly to increase the exercise value of such movement to the user.

6. A lower extremity exercise apparatus in accordance with claim 4 wherein such resistance means incorporates a resilient material.

7. A lower extremity exercise apparatus in accordance with claim 1 wherein the foot contact and support means can pivot downwardly on both ends and is provided with resistance means on both ends to provide additional exercise to a user in effecting such movement.

8. An apparatus for exercising the lower extremities comprising:

(a) a ground plane contact and support means, (b) a pair of foot pedals having a pivoting arrangement facilitating forward and backward rocking about an axis disposed in a location within one of the ground plane contact and support means and the pair of foot pedals, (c) the assumable angle of the foot pedals allowed by the pivoting arrangement being variable between an assumed maximum backwardly rocked angle of the foot of a normally supple seated individual and the maximum forwardly rocked angle of the foot of such individual; and, (d) the pivoting arrangement of the foot pedals comprising:

(i) a pivot extension support extending from one of the ground plane contact and support means and the foot pedals, at one end of which pivot extension support there is a transverse at least semi-cylindrical pivot member;

(ii) a semicircular pivot groove adapted for receiving the semi-cylindrical pivot member in the opposite of one of the ground plane contact and support means and the foot pedals;

(e) whereby the foot pedals are pivotable about the axis which extends longitudinally through the semi-cylindrical pivot member and pivot groove with a rocking motion.

9. An apparatus for exercising the lower extremities in accordance with claim 8 additionally comprising:

(f) resilient means positioned between the foot medals and around plane contact and support means for exerting back resistance in opposition to the rocking motion of the foot pedals in at least one direction.

10. An apparatus for exercising the lower extremities in accordance with claim 9 wherein the resilient means oppose rocking movement of the foot pedals in both rocking directions.

11. An apparatus for exercising the lower extremities in accordance with claim 10 wherein the pivot support is closely adjacent or below the surface of the ground plane contact and support means.

12. An apparatus for exercising the lower extremities in accordance with claim 11 wherein the resilient means is a resilient extendable elastic means.

13. An apparatus for exercising the lower extremities in accordance with claim 12 wherein the resilient extendable elastic means is of a polymeric composition.

14. An apparatus for exercising the lower extremities in accordance with claim 9 wherein the pair of foot pedals have heel positions and ball of the foot positions and wherein the pivot point of the pivoting arrangement is disposed approximately from three-sixteenths of the distance from the rear of the heel position to nine-sixteenths of the distance from the rear of the heel position on the foot pedals.

15. An apparatus for exercising the lower extremities in accordance with claim 14 wherein the pivot points of the pair of foot pedals are disposed approximately from one quarter of the distance from the rear of the heel position to one half the distance from the rear of the heel position on the foot pedals.

16. A lower extremity exercise apparatus adapted for facilitating movement of the feet and lower legs of a seated person comprising:

(a) a base, (b) at least one foot contact and support means having a length sufficient to make contact with at least the major portions of the sole of a human foot, (c) said foot contact and support member being pivotally journaled with respect to the base upon a pivot means associated with said base for pivotal movement above the base and having a heel position and ball of the foot position, (d) the pivot point of said pivot means being disposed approximately from three-sixteenths of the distance from the rear of the heel position to nine-sixteenths of the distance from the rear of the heel position on the foot contact and support member in the foot contact and support member, and, (e) the pivot point of the foot contact and support means being disposed with respect to said contact and support means and base such that the angle of the foot contact and support means, when pivoted downwardly toward the base upon one end, will provide an angle of the foot contact and support means such that a seated person may comfortably rest their feet upon the upper surface of the foot contact and support means from a seated position and can move or rock the far end of the foot contact and support means downwardly with the forward portion of at least one of their feet by downward pressure from said forward portion of their foot and can move or rock the near end of the foot contact and support means downwardly with the rear portion of at least one of their feet, (f) the pivot of said foot contact and support means being comprised of a transverse pivot opening effectively in one of the base and the foot contact and support means and a cylindrically configured transverse pivot member adapted to be received in the transverse pivot opening and supported upon an extension from one of the foot contact and support means and the base.

17. A lower extremity exercise apparatus in accordance with claim 1 wherein the pivot point of said pivot means is disposed from one quarter of the distance from the rear of the heel position to one half the distance from the rear of the heel position.

18. A lower extremity exercise apparatus in accordance with claim 1 wherein the pivot point of the foot contact and support means is positioned within the base.

19. A lower extremity exercise device in accordance with claim 16 wherein the pivot point of said pivot means is accommodated in the base of the invention.

20. A lower extremity exercise device in accordance with claim 16 wherein the pivot point of said pivot means is accommodated in the foot contact and support means.

21. An apparatus for exercising the lower extremities comprising:

(a) a ground plane contact and support means, (b) a pair of foot pedals having a pivoting arrangement facilitating forward and backward rocking about an axis disposed in a location within one of the ground plane contact and support means and the pair of foot pedals, (c) the assumable angle of the foot pedals allowed by the pivoting arrangement being variable between an assumed maximum backwardly rocked angle of the foot of a normally supple seated individual and the maximum forwardly rocked angle of the foot of such individual, (d) the pivoting arrangement of the foot pedals comprising:

(i) a pivot extension support extending from one of the ground plane contact and support means and the foot pedals, at one end of which pivot extension support there is a transverse at least semi-cylindrical pivot member;

(ii) a semicircular pivot groove adapted for receiving the semi-cylindrical pivot member in the opposite of one of the ground plane contact and support means and the foot pedals;

(e) whereby the foot pedals are pivotable about the axis which extends longitudinally through the semi-cylindrical pivot member and pivot groove with a rocking motion.

22. An apparatus for exercising the lower extremities in accordance with claim 14 additionally comprising:

(e) resilient means arranged and positioned to provide resistance to rocking movement of the at least one foot pedal.

23. An apparatus for exercising the lower extremities in accordance with claim 22 wherein the resilient means resists rocking movement of the foot pedals in both directions.

24. An apparatus for exercising the lower extremities in accordance with claim 23 wherein the at least one foot pedal has a heel position and ball of the foot position and wherein the pivot point of the pivoting arrangement is disposed approximately from one quarter of the distance from the rear of the heel position to one half of the distance to the rear of the heel position on the foot pedals.

* * * * *